United States Patent [19]

Sakaguchi et al.

[11] 4,295,915

[45] Oct. 20, 1981

[54] LABEL HANDLING APPARATUS

[75] Inventors: Tadahiro Sakaguchi, Nishinomiya; Masamichi Hino, Suita; Setsuo Tsuji, Hashimoto; Akiyoshi Hashido, Yao; Kazuyoshi Enomoto, Kawachinagano, all of Japan

[73] Assignee: Kubota Ltd., Osaka, Japan

[21] Appl. No.: 103,948

[22] PCT Filed: Feb. 22, 1979

[86] PCT No.: PCT/JP79/00042

§ 371 Date: Sep. 24, 1979

§ 102(e) Date: Sep. 24, 1979

[87] PCT Pub. No.: WO80/00827

PCT Pub. Date: May 1, 1980

[30] Foreign Application Priority Data

Oct. 13, 1978 [JP] Japan ..... 53-126332
Oct. 13, 1978 [JP] Japan ..... 53-126333
Oct. 13, 1978 [JP] Japan ..... 53-126335

[51] Int. Cl.[3] ..... B65H 25/00

[52] U.S. Cl. ..... 156/361; 156/363; 156/384; 156/542; 156/584

[58] Field of Search ..... 156/361, 363, 384–387, 156/344, 584, 540–542, 285

[56] References Cited

U.S. PATENT DOCUMENTS 3,329,550 7/1967 Kucheck ..... 156/285
3,483,059 12/1969 Dinter ..... 156/542 X
3,985,603 10/1976 Berner ..... 156/584 X
3,985,605 10/1976 Treiber et al. ..... 156/584

*Primary Examiner*—David A. Simmons
*Attorney, Agent, or Firm*—W. G. Fasse; D. F. Gould

[57] ABSTRACT

A label handling apparatus comprises a label issuing machine (2) for weighing an article, printing predetermined data, such as the measured weight, price per unit weight and article price, on a label on the basis of the measured weight, and issuing the printed label, a transfer device (40) for transferring the issued label on a belt conveyor (42), and a label sticking device (9) for sucking and retaining the transferred label at a label retaining port (15) by a negative pressure produced by an air current and producing a positive pressure in the label retaining port (15) by an air current with a predetermined timing to blow off the sucked and retained label so as to stick it to a predetermined place on the article. Such labels are prepared in advance with a viscous adhesive agent applied thereto and temporarily retained on a mount sheet, from which they are stripped during their travel from the label issuing machine (2) to the label transfer device. The label blown off from the label retaining port (15) sticks to the article under the action of the viscous adhesive agent.

51 Claims, 29 Drawing Figures

LABEL HANDLING APPARATUS

TECHNICAL FIELD

The present invention relates to a label handling apparatus adapted to automatically carry out steps starting with preparing labels having an adhesive agent applied to one of their respective surfaces, with the other surfaces visibly bearing data, such as prices, and ending with transferring them to a desired position and sticking them to objects, such as articles of commerce.

BACKGROUND ART

The label handling art which forms the background of the invention is used for carrying out the operation of sticking labels indicating data such as prices to articles which are to be priced on a weight basis.

Typically, labels are temporarily retained on a backing strip through an adhesive agent of viscous material, and in this state they are subjected to desired printing and then stripped from the backing strip and stuck to articles. As for such label handling apparatus, there have heretofore been separately proposed two types, one which has the function of the so-called label issuing machine adapted to print labels retained on a backing strip and substantially strip such printed label from the backing strip by a stripping plate, whereupon the operator grips the substantially stripped label and sticks it to a predetermined place on the article, and the other, or the so-called label sticking device wherein a label stripped from the backing strip by a stripping plate is retained at a label retaining section and then stuck to a predetermined place on the article as by using a blowing air current to fly the label.

In the former case, the sticking means is manual in that the operator has to take up the label and stick it to the article by hand. Therefore, it is possible to stick the label to any desired place on the article irrespective of the size and shape of the article. However, this manual label sticking means, which makes it necessary to take up the labels one by one by hand, requires much time and labor and is inefficient.

On the other hand, in the latter case, since the stripped label is automatically stuck to the article, the sticking means is automatic and in this sense it is efficient. However, depending upon the size and shape of the article, it is not always possible to stick the label to any desired place on the article, and when it is desired to provide positional freedom for sticking labels, it is necesary to position the label retaining section of the label sticking device immediately above the position to which the label is brought and at which the sticking of a label is desired, since it is from this label retaining section that the label comes flying. Therefore, the label brought to the label retaining section has to be stripped from the backing strip immediately adjacent said retaining section, and the label stripping section of the label issuing machine has to be so constructed as to project from the label issuing device over a long distance. Therefore, a mere combination of the label retaining section of the label sticking device with the label issuing machine would not be usable in practice. Accordingly, it has been usual practice separately to produce label issuing devices and label sticking devices whose label stripping sections are so constructed as to project from the label issuing devices over a long distance.

As for conventional label sticking devices, those using an air current to perform the label retaining and sticking operation have been proposed, but each is complicated in construction, liable to get out of order, lacking in reliability and expensive.

Accordingly, a principal object of the invention is to provide a label handling apparatus adapted to automatically and efficiently carry out a series of steps starting with preparing labels and ending with sticking them to articles.

Another object of the invention is to provide a preferable label transfer device extending from the label issuing device to the label sticking device.

A further object of the invention is to provide a label sticking device which is simple in construction, liable to little malfunction, reliable inexpensive.

Still a further object of the invention is to provide a label handling apparatus equipped with preferable control means, improving efficiency of operation and increasing reliability in label sticking operation.

SUMMARY OF THE INVENTION

In brief, the invention provides a label handling apparatus comprising label preparing means for preparing labels having an adhesive agent applied to one of their respective surfaces, with the other surfaces visibly bearing desired data such as prices, sticking means for sticking said prepared labels to objects such as articles of commerce, transfer means for transferring said labels from said label preparing means to said label sticking means, and control means for controlling relative timing between the label preparing operation in the label preparing means and the label sticking operation in the sticking means. With this apparatus a series of steps starting with preparing labels and ending with sticking them to articles can be automatically and efficiently carried out.

In a preferred embodiment of the invention, a label preparing means is combined with a weighing device to provide a label issuing machine which prints data such as measured weight provided by said weighing device and prices on the basis of said measured values. Thereby, it is possible to efficiently carry out the operation starting with weighing articles and ending with sticking labels, each indicating various data on the basis of the measured weight of the article, to the articles. In such case, according to another preferred embodiment of the invention, said control means controls the operation in such a manner as to assure that a label will be positively fed to the label sticking means to increase reliability in the label sticking operation and that the next label will be automatically fed to the label sticking means after the completion of the sticking of the preceding label and before the beginning of the next label sticking to thereby increase the efficiency of operation.

In another preferred embodiment of the invention, the label sticking means comprises air current producing means for producing an air current to thereby create a positive pressure atmosphere and a negative pressure atmosphere, an atmosphere chamber adapted to selectively communicate with either said positive pressure atmosphere or said negative pressure atmosphere produced by said air current producing means, gate means for making such selection, and a gate means driving device for driving and controlling said gate means, the arrangement being such as to blow off or suckwise retain a label depending upon the positive or negative pressure in said atmosphere chamber. To this end, the atmosphere chamber is formed with a label retaining port communicating with the ambient air. In another embodiment of the invention, a configuration convenient for suckwise retaining and blowing labels is provided in connection with said label retaining port.

Yet another preferred embodiment of the invention includes means for giving instructions for stating the sticking operation of the sticking means, and retriggerable timer means adapted to be triggered by a signal from said instructing means to drive the transfer means for specified period of time. Thereby, it is possible to shorten the operating time of the transfer means and thereby prolong its useful life without lowering the efficiency of sticking operation.

In still a further embodiment of the invention, the transfer means includes a moving part for transferring a label while contacting at least a portion of the surface of the label having an adhesive agent applied thereto, said moving part being so arranged that its contact with the label will not scrape the adhesive agent and that even if it is scraped and adheres to the moving part, the scraped adhesive agent will not be transferred to other parts which are in contact with the label.

DESCRIPTION OF THE DRAWINGS

FIGS. 9 through 13 illustrate other embodiments of arrangements associated with the transfer device portion; wherein FIG. 9 is a front view of a principal portion; FIG. 10 is a sectional view of a principal portion;

FIG. 11 is a sectional view of a principal portion;

FIG. 12 is a sectional view of a principal portion; and

FIG. 13 is a sectional view of a principal portion;

FIGS. 14 and 15 illustrate other embodiments of arrangements associated with the label retaining port of the sticking device portion; wherein FIG. 14 is a sectional view of a principal portion; and FIG. 15 is a perspective view of a principal portion as viewed from below;

BEST MODE FOR CARRYING OUT THE INVENTION

The objects of the invention described above and other objects and features will become more apparent from the following detailed description given with reference to the accompanying drawings.

The following description of the preferred embodiments of the invention will be given separately in two parts, one concerning embodiments of mechanisms for the label handling apparatus of the invention, and the other concerning control means for controlling said mechanisms. The mechanical aspect of the invention will first be described.

Figure 1:
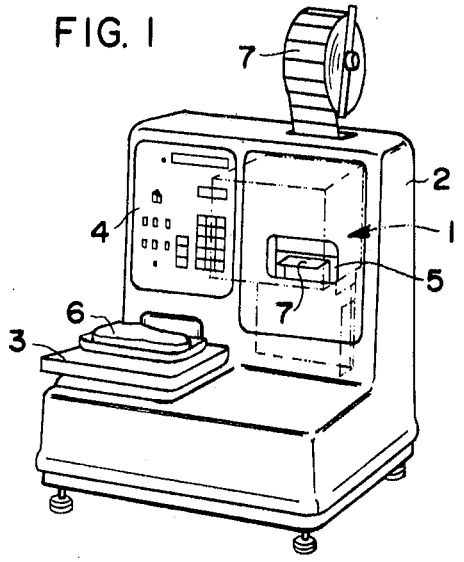
FIG. 1 is a perspective view illustrating the complete configuration of an embodiment of the invention, with a label transfer device and label sticking device portion shown in phantom lines.
Figure 2:
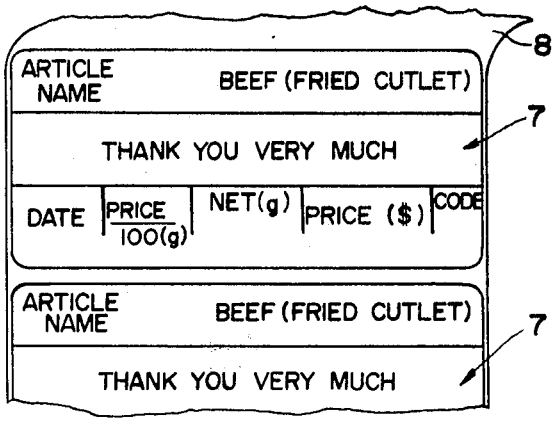
FIG. 2 is a plan view illustrating an example of a label retained on a backing strip which can be advantageously used in the apparatus of the invention.

FIG. 1 is a perspective view illustrating the complete configuration of an embodiment of the invention, with a label transfer device and label sticking device portion shown in phantom lines. FIG. 2 is a plan view illustrating an example of a label retained on a backing strip which can be advantageously used in the apparatus of the invention. In FIG. 1, a label transfer device and label sticking device portion 1 is illustrated in phantom lines, in comparison with a label issuing machine 2. This way of illustration is intended to show that the label handling apparatus of the invention can be advantageously obtained by combining said label transfer device and label sticking device portion 1 with the label issuing machine 2 which has heretofore been commercially available.

Referring to FIG. 1, the label issuing machine 2 comprises a weighing pan 3, an operating panel 4 and a label delivering port 5. Though not clearly shown, the operating panel 4 is provided with operating keys, operating switches and display section so that data, such as price per unit weight, process date, limit date, and article code number, may be transferred thereto to give a visible display of the price per weight, measured weight, and price. An article 6 placed on the weighing pan 3 is an article of food or the like which is priced on a weight basis. In the label handing apparatus of the invention, a label 7 on which predetermined data are printed in the label issuing machine 2 on the basis of the measured value of weight of the article 6 is issued and stuck to a suitable place on the article 6. A number of such labels 7 are temporarily retained on a backing strip 8 (FIG. 2) which is then rolled and supported at the top of the label issuing machine 2 so that it may be withdrawn.

Referring to FIG. 2, labels 7 are shown already printed with data. The data include article name "Beef" (for Fried Cutlet), process date, price per unit weight, net weight (g), article price, and a code number. Such printing is effected in the label issuing machine 2 (FIG. 1) and for this purpose the label issuing machine 2 includes a printing device. The labels 7 have a viscous adhesive agent applied in advance to one of their respective surfaces and are temporarily retained on the backing strip 8 under the action of said viscous adhesive agent. That surface of the backing strip 8 which is in contact with the labels 7 has been subjected to a known preferable surface treating process, so that the labels 7, through adhering to the backing strip 8 through the adhesive agent, can be easily stripped therefrom. The labels 7, when stripped from the backing strip 8, are fed to the label transfer device and label sticking device portion 1. For this purpose, the label issuing machine 2 includes a label stripping device.

Thus, the label issuing machine 2 shown in FIG. 1 has the functions of printing predetermined data on a label 7 on the basis of the measured weight of the article 6 placed on the weighing pan 3, and feeding said printed label 7 from a label delivery port 5 to the subsequent label transfer device and label sticking device portion 1.

Figure 3:
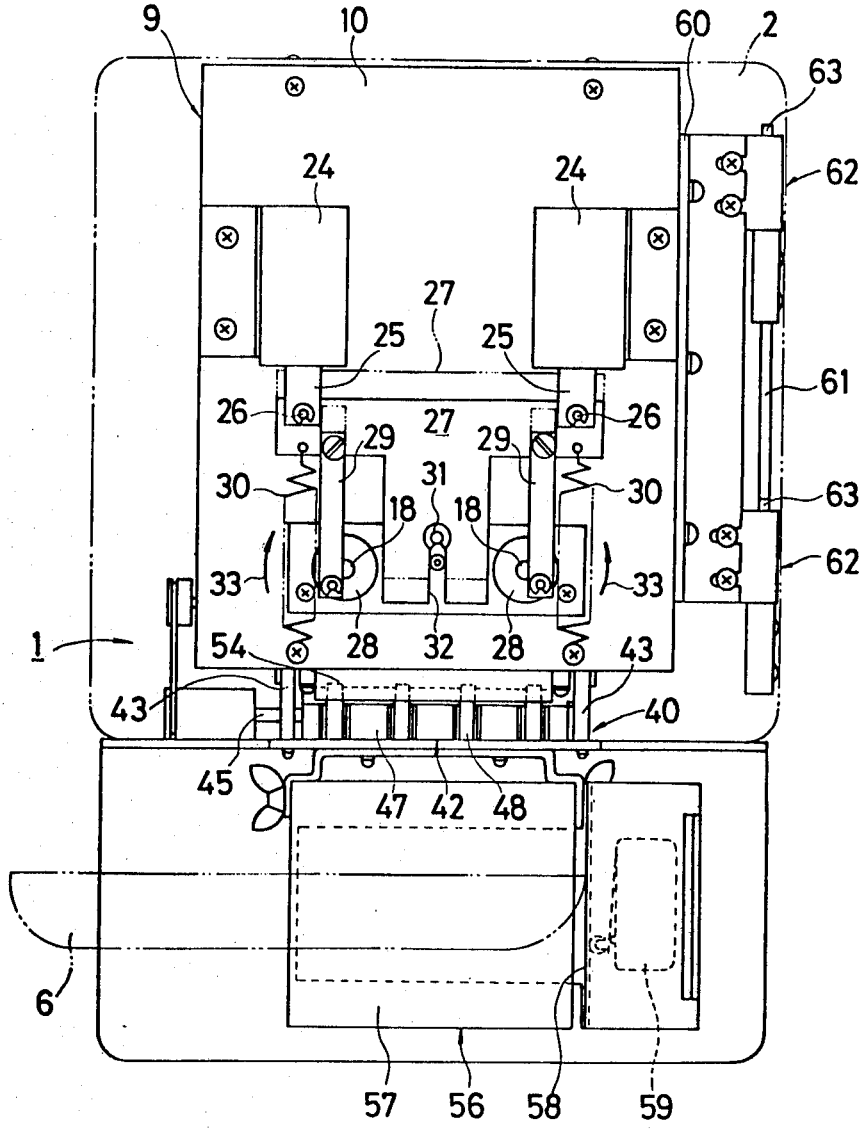
FIG. 3 is a front view of the label transfer device and label sticking device portion.
Figure 4:
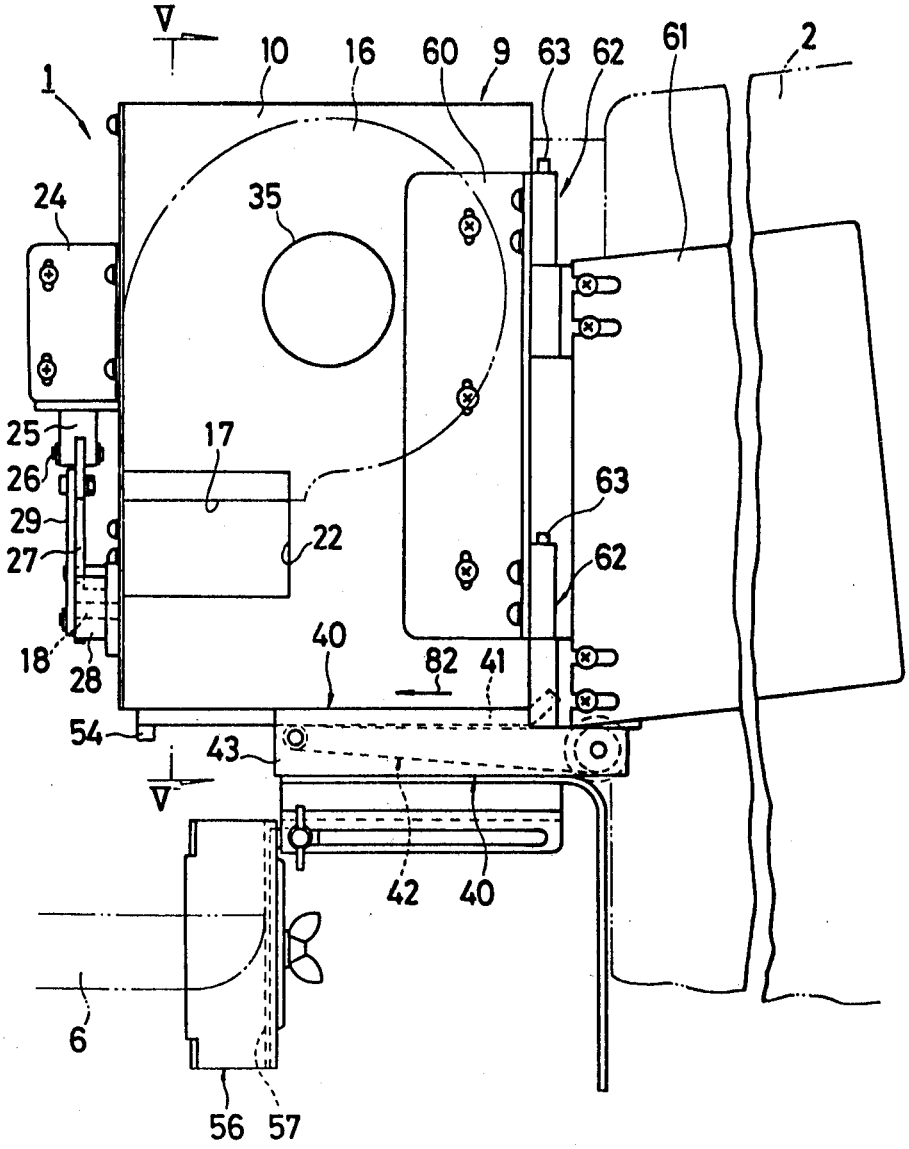
FIG. 4 is a side view of the same.
Figure 5:
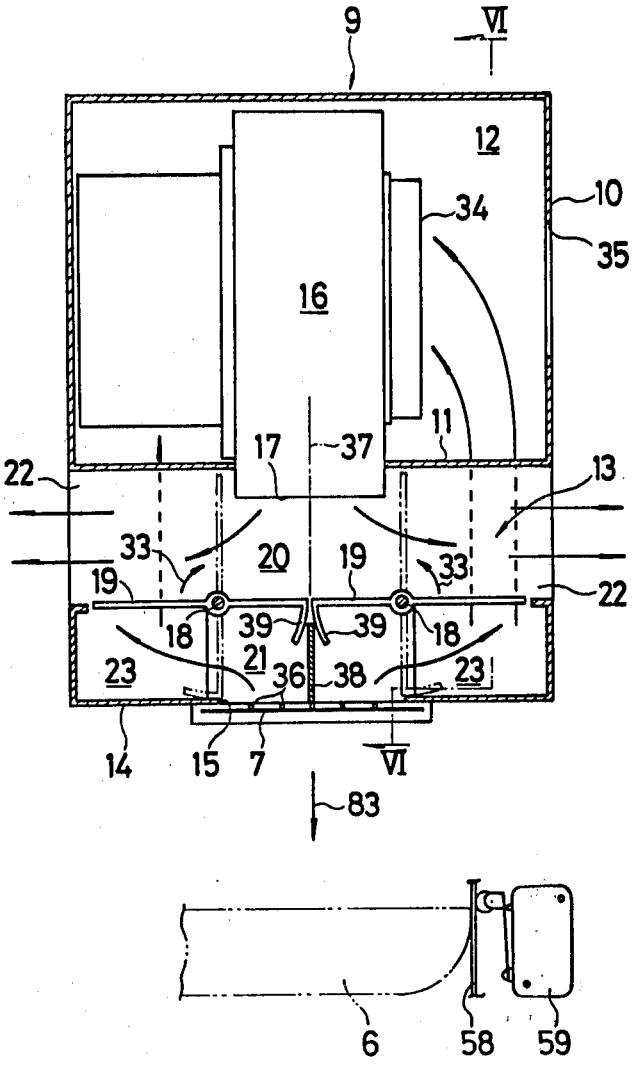
FIG. 5 is a sectional view taken along the line V—V of FIG. 4.

FIG. 3 is a front view of the label transfer device and label sticking device portion; FIG. 4 is a side of the same; FIG. 5 is a sectional view taken along the line V—V of FIG. 4; and FIG. 6 is a sectional view taken along the line VI—VI of FIG. 5.

Referring to FIGS. 3 through 6, the construction of a label sticking device 9 included in the label transfer device and label sticking device portion 1 and attached to and horizontally extending from the front of the label issuing machine 2 will be described. The label sticking device 9 includes a case 10 forming an air chamber, the interior of said case 10 being divided into a large chamber 12 and a small chamber 13 by a partition plate 11. The bottom plate 14 of the case 10, or the lower wall of the small chamber 13, is formed with a throughgoing aperture to form a label retaining port 15. Installed in the large chamber 12 is a fan box 16 containing a Silocco fan or the like, with the blowing port 17 of said fan box 16 extending through the partition plate 11 to be positioned above the label retaining port 15. A pair of rotary shafts 18 are rotatably mounted inside the samll chamber 13 and on opposite sides of an air blowing passage which connects the label retaining port 15 and the blowing port 17, each of said rotary shaft 18 carrying a gate 19 fixed at its middle thereon. When the gates 19 are in their horizontal position, they divide the small chamber 13 into an upper chamber 20 and a lower chamber 21, thus closing the air blowing passage. Opposite side walls of the case 10 are each formed with a first communication aperture 22 to establish the communication between the upper chamber 20 and the ambient air, while the partition plate 11 is formed at its opposite ends with second communication apertures 23 to establish communication between the lower chamber 21 and the large chamber 12. A pair of solenoids 24 are fixed as by screws to the outer surface of the front wall of the case 10. The front ends of the plungers 25 of the solenoids 24 are connected to a T-shaped plate 27 by pins 26. Installed on the outer surface of the front wall of the case 10 are wedging discs 28 fixed on the rotary shafts 18 for rotation with the latter. Connecting rods 29 are conected at their ends by pins between the horizontally extending portion of the T-shaped plate 27 and the wedging discs 28 adjacent the outer peripheries thereof. The T-shaped plate 27 is permanently downwardly pulled by springs 30. There is a pin 31 projecting from the case 10 and received in a vertical slit 32 formed in the downwardly extending portion of the T-shaped plate 27, thereby preventing the rocking of the T-shaped plate 27. Therefore, when the solenoids 24 are actuated to withdraw the plungers 25, the T-shaped plate 27 and connecting rods 29 are upwardly displaced (as indicated by phantom lines in FIG. 3) and hence the wedging discs 28 are turned in the directions of arrows 33, whereby the rotary shafts 18 bring the gates 19 from their horizontal position shown in solid lines in FIG. 5 to their erected position shown in phantom lines. The wall of the case 10 opposed to the suction port 34 of the fan box 16 is provided with an air flow adjusting aperture 35 for increasing the amount of air drawn into the suction port 34 of the fan box 16. As will become apparent from a description of the action of air to be given later, in the label sucking and retaining state, the air flow adjusting aperture 35 performs the function of reducing the sucking force exerted in the label retaining port 15 by drawing an amount of air to thereby correspondingly reduce the amount of air drawn through the label retaining port 15, while in the label blowing state, it performs the function of increasing the air blowing force exerted in the label retaining port 15 by drawing an amount of air to supplement the amount of air drawn through the first communication apertures 22. In this sense, the size of air flow adjusting aperture 35 may be determined in the design stage by taking the fan capacity and other factors into consideration or it may be made adjustable. A plurality of label retaining bars 36 arranged at predetermined intervals are installed at the label retaining port 15 which is adapted to retain the labels 7. Therefore, a label 7 arriving at the label retaining port 15 will be sucked and retained while adhering to the label retaining bars 36. In the lower chamber 21, a flow regulating plate 38 is disposed in a geometric plane including the center line of the label retaining port 15 and the center line of the blowing port 17 of the fan box 16. The gates 19 are formed with turnbacks 39 projecting from the opposed ends thereof and extending toward the label retaining port 15. When the gates 19 are turned from their horizontal position in the directions of arrows 33, said flow regulating plate 38 serves to prevent the turbulent flow of air blown from the blowing port 17 and to regulate it in such a manner as to direct the air to the middle of the label 7 retained at the label retaining port 15 so as to fly the label 7 exactly vertically downward. Further, the turnbacks 39 formed on the gates 19 serve to shut the second communication apertures 23 more quickly than when such turnbacks are not provided, cutting down the time of switching between suction and blow, whereby the length of time the label is subjected to the sucking and blowing actions is shortened to eliminate the possibility of the label 7 becoming excessively warped, thus enabling the label 7 to fly in a straight line.

Disposed below the case 10 of the label sticking device 9 described above is a label transfer device 40. In addition, the label transfer device 40 is omitted from the illustration in FIG. 5.

Figure 6:
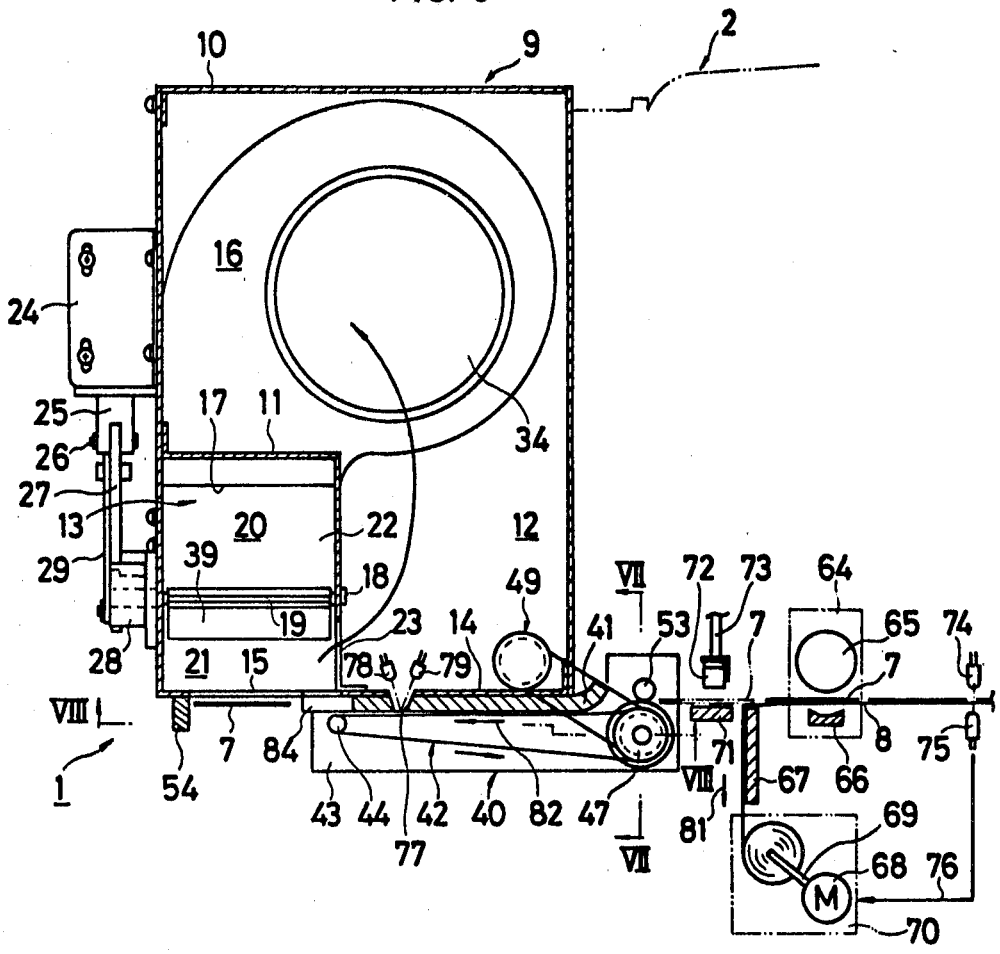
FIG. 6 is a sectional view taken along the line VI—VI of FIG. 5.
Figure 7:
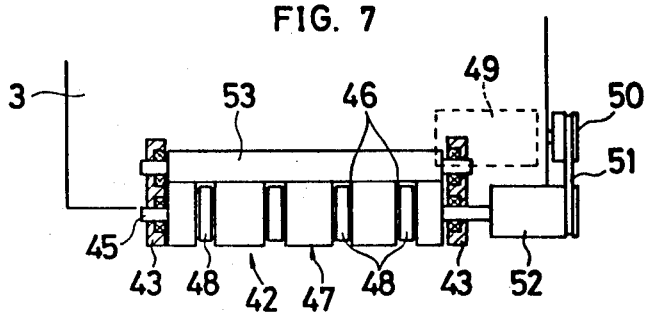
FIG. 7 is a sectional view of the transfer device portion taken along the line VII—VII of FIG. 6.
Figure 8:
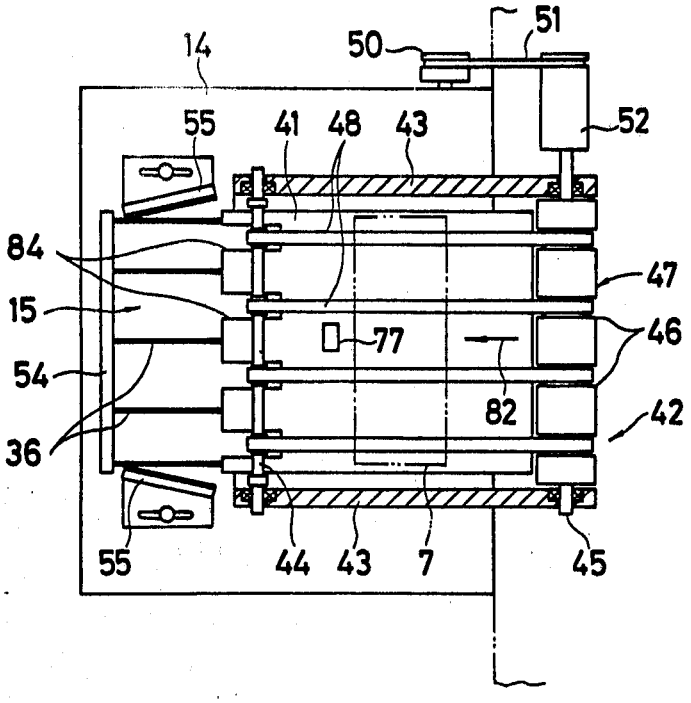
FIG. 8 is a sectional view taken along the line VIII—VIII of FIG. 6.

FIG. 7 is a sectional view of the label transfer device 40 taken along the line VII—VII of FIG. 6, and FIG. 8 is a sectional view taken along the line VIII—VIII of FIG. 6. Referring to FIGS. 3, 4 and 6 through 8, the label transfer device 40 comprises a guide plate 41 fixed to the lower surface of the case 10, and a belt conveyor 42 installed close to the lower surface of said guide plate 41. The belt conveyor 42 includes a pair of frames 43 parallel to each other and fixed to the lower surface of the case 10. A small diameter roller 44 is rotatably supported at its ends in said frames 43 adjacent the label retaining port 15. Also in the frames 43, a support shaft 45 is rotatably supported at its opposite ends adjacent the label issuing machine 2. Fixed on the support shaft 45 is a large diameter roller 47 having four annular grooves 46. Four relatively expansible belts 48 are mounted around and between the annular grooves 46 of the large diameter roller 47 and the small diameter roller 44. Preferably, the belts 48 are made of silicone rubber. Fixed on the bottom plate 14 of the case 10 is a drive motor 49 which drives the large diameter roller 47 together with the support shaft 45 at high speed through a pulley 50, a belt 51 and a pulley 52. A presser roller 53 is provided in contact with or close to the large diameter roller 47 and rotatably supported in the frames 43. The presser roller 53 is driven by the rotation of the large diameter roller 47 or by the movement of the label 7.

The belt conveyor 42 described above conveys the label 7 to the label retaining port 15. A stop 54 and positioning plates 55 are provided around the label retaining port 15 and project downwardly. The stop 54 and positioning plates 55 serve to properly position the label 7 conveyed to the retaining port 15 and are screwed to the lower surface of the case 10 so that their positions can be adjusted. The positioning plates 55, as best seen in FIG. 8, are disposed with their spacing gradually narrowed toward the stop 54 to thereby guide the opposite lateral edges of the label 7, thus assuring that the position occupied by such label 7 arriving at the label retaining port 15 is always constant with respect to the latter.

A positioning device 56 for the article 6 is dependent from the label transfer device 40 described above and is arranged so that its position can be adjusted. The positioning device 56 serves to position the article 6 by its two reference surfaces 57 and 58 against which the article abuts, thereby positioning the place on the article 6 to which the label 7 is to be stuck. The reference surface 58 is slightly displaceable in a direction perpendicular to this surface and is provided on its back with a limit switch 59. Therefore, the limit switch 59 will be closed upon displacement of the reference surface 58. The limit switch 59 is used to actuate the previously described solenoids 24.

The portion 1 including the label sticking device 9 and label transfer device 40 described above is attached to the label issuing machine 2 in the following manner: A first attaching plate 60 is screwed to the label sticking device 9, while a second attaching plate 61 is screwed to the label issuing machine 2. The first and second attaching plates 60 and 61 are connected together by hinges 62 having support shafts 63 around which the label sticking device 9 can be turned horizontally. In addition, a locking device (not shown) for inhibiting said turning movement so as to fix the label sticking device 9 to the label issuing machine 2 is provided between the other lateral surface of the label sticking device 9 and the label issuing machine 2.

Referring to FIG. 6, that portion of the arrangement of the label issuing machine which is most relevant to the label transfer device 40 will now be described. The labels 7 retained on the backing strip 8 (FIG. 2) wound into a roll form shown in FIG. 1 are introduced into a line printer 64. The line printer 64, which prints weight, price per unit weight, article price, etc., on the labels 7 on the basis of measured weight indicated by the weighing device includes a type wheel 65 and a type hammer 66. When the labels 7 pass through the type printer 64, they are still retained on the backing strip 8. A stripping plate 67 is provided for stripping the labels 6 from the backing strip 8. The stripping plate 67 effects stripping by sharply bending the backing strip 8 while utilizing the stiffness of the labels 7. The backing strip 8 is rewound on a shaft 69 rotated by a motor 68. Thus, in the label issuing machine 2, the feeding of the backing strip 8 results in transferring the labels 7. Further, as is apparent from the arrangement of the stripping plate 67, by feeding the backing strip 8, the labels 7 are stripped from the backing strip 8. A device 70 for feeding the backing strip 8 is adapted to intermittently feed the backing strip at predetermined intervals of time. A label 7 partly stripped by the stripping plate 67 is placed on a guide table 71 and then guided to the transfer device 40 by the backing strip 8 until it is completely stripped from the backing strip 8. When the leading edge of the label 7 is nipped between the larger diameter roller 47 the presser roller 53 of the transfer device 40, the label 7 is introduced into the transfer device 40 at high speed. In addition, since the upper surface of the guide table 71 is contacted by the adhesive-coated surface of the label 7, a file-like surface or other suitable surface treatment has been applied to said upper surface so as to assure smooth transfer of the labels 7. The guide table 71 also serves as a printing table, and a printing plate 72 for printing article names is disposed above said printing plate 72, the latter being adapted to be moved up and down by a drive 73 with a predetermined timing.

In the label issuing machine 2 described above, the intermittent feed device 70 is adapted to intermittently feed the backing strip 8 in response to a printing completion signal produced upon completion of printing effected by the line printer 64 and printing plate 72. The transfer pitch of the intermittent feed device 70 is determined upon detection of the spacing the adjacent labels by means of a photoelectric detection provided at a suitable position bofore the line printer 64 and comprising a light emitting part 74 and a light receiving part 75. As a similar optical detector for detecting the passage of a label 7 through the transfer device 40, there is provided a photoelectric detector which comprises a light emitting part 78 and a light receiving part 79 and which is associated with an opening 77 formed in the guide plate 41.

The function of the mechanical arrangement described above will now be described. In the label issuing machine 2, predetermined data (including weight, price per unit weight, and article price) obtained on the basis of a measured weight provided by the weighing device (to be later described in more detail with reference to FIG. 19) are printed on the label 7 by pressing the latter against the type wheel 65 by the type hammer 66. When the backing strip 8 is intermittently fed in the direction of arrow 81, the label 7 is partly stripped from the backing strip 8 by the stripping plate 67 and brought onto the printing table 71. The printing plate 72 is then pressed against the label 7 by means of a drive 73, so that the article name is printed on the label 7. In addition, in this state, the label 7 has not yet been completely stripped from the backing strip 8. After the printing of the article name, the backing strip 8 is intermittently fed again by the intermittent feed device 70. As a result, the leading edge of the label 7 is forced between the large diameter roller 47 and the presser roller 53 of the transfer device 40, whereby the label 7 is introduced into the transfer device 40 and transferred in the direction of arrow 82. Thus, the label 7 has become completely stripped from the backing strip 8. Since the large diameter roller 47 of the transfer device 40 is rotating at a high speed (e.g., a surface speed of 100 m/min.), the label 7 is driven at high speed in the direction of arrow 82 between the belts 48 and the guide plate 41 to reach the label retaining port 15. At the label retaining port 15, the label 7 is positioned or guided by the action of the stop 54 and positioning plates 55 to occupy a predetermined position with respect to the retaining port 15. Since the belts 48 are driven at high speed and they are made of silicone rubber and since the roller 44 disposed adjacent the retaining port 15 is of relatively small diameter, the label 7 will be readily released from the belts 48 and fed to the retaining port 15 despite the fact that a viscous adhesive agent has been applied to the back of the label 7.

With the label 7 placed at the retaining port 15, the gates 19 are in their horizontal position and, as shown by arrows in FIGS. 5 and 6 indicating the path of air currents, the air is drawn into the suction port 34 of the fan box 16 via the label retaining port 15 and second communication apertures 23 and is blown from the delivery port 17 of said fan box 16 into the outside via the first communication apertures 22. Therefore, the label 7 positioned at the retaining port 15 is sucked and clings to the retaining bars 36. Thus, it is sucked and retained at the retaining port 15.

When the article 6 is brought into abutment against the two reference surfaces 57 and 58 of the positioning device 56, the limit switch 59 is closed to actuate the solenoids 24 to lift the T-shaped plate 27 and connecting rods 29 against the force of the springs 30, turning the wedging discs 28 in the directions of arrows 33, so that the gates 19 are turned in said directions of arrows 33 by the shafts 18. As a result, the gates 19 are brought to their erected position from their horizontal position. Consequently, the air from the blowing port 17 of the fan box 16 is blown toward the label 7. In this connection, it is to be noted that when the gates 19 are turned in the directions of arrows 33 from their horizontal position, the air blown from the blowing port 17 is guided by the gates 19 to be gathered at the middle, but the flow regulating plate installed at the middle of the lower chamber 21 causes said gathered air to flow downwardly along the flow regulating plate to hit the middle of the label 7, causing the latter to fly downwardly in a straight line. Also, the provision of the turnbacks 39 on the gates 19 assures that the second communication apertures 23 are shut before the gates 19 are completely erected. Thus the time period when both the sucking air and the flowing air are simultaneously effective is shortened, whereby the label 7 is not excessively warped and it can be flown downwardly in a straight line. In this manner, the label 7 at the retaining port 15 is flown in the direction of arrow 83 by the blowing air, and it is stuck to a predetermined place on the article 6.

Referring to FIG. 8, preferably, the guide plate 41 and the bottom plate 14 of the case 10 are provided with notches 84 located at the initial end of the opening which forms the label retaining port 15. The notches 84 are positioned overlapping the terminal end of the belt conveyor 42. The notches 84, like the label retaining port 15, are so constructed as to communicate with the previously described lower chamber 21. Therefore, in the label sucking and retaining state, it follows that the notches 84 as well as the label retaining port 15 are drawing the air. This arrangement brings about the following advantage: If such notches 84 are absent, it is not until about half the length of the label has left the belt conveyor 42 that it is sucked by the retaining port 15. This, coupled with the fact that the label 7 is being fed at high speed in the direction of arrow 82, would cause a danger of the label 7 flying past the lower end of the stop 54 rather than hitting the latter. With the notches 84 present, however, before leaving the belt conveyor 42, the label 7 has already been sucked and has been brought into abutment with the bottom plate 14 of the case 10. Upon complete detachment of the label 7 from the belt conveyor 42, the label 7 advances along the bottom plate 14 until it abuts against the stop 54, whereupon it is sucked and retained at the retaining port 15. Thus, there is no danger of it flying past the lower end of the stop 54.

FIGS. 9 through 13 illustrate other embodiments of arrangements associated with the label transfer device 40. Constructional features of said embodiments will now be described with reference to FIGS. 9 through 13.

Figure 9:
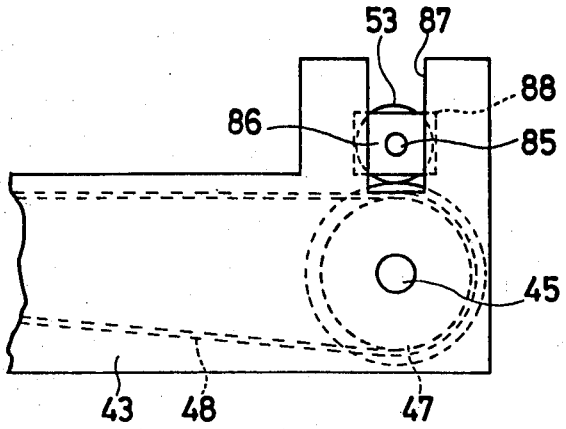

Referring to FIG. 9, the support shafts 85 for the opposite ends of the presser roller 53 are rotatably mounted in bearing blocks 86. Although FIG. 9 shows only one side, the other side is the same in arrangement. Each bearing blocks 86 is vertically displaceably received in a vertically directed guide groove formed in the associated frame 43. Fixed to the bearing block 88 is a guide plate 88 abutting against the lateral surface of the frame 43. With this arrangement, the presser roller 53 abuts against the top of the large diameter roller 47 under its own weight, and when the label 7 is inserted into the nip between the large diameter roller 47 and the presser roller 53, the presser roller 53 is upwardly displaced a distance corresponding to the thickness of the label 7.

Therefore, unlike the case where the axis of the presser roller 53 is fixed, there is no danger of the label 7 being pressed too strongly between the presser roller 53 and the large diameter roller 47, nor is a danger that, reversely, the clearance between the rollers 47 and 53 is too large for the thickness of the label 7, causing trouble to the transfer of the label. Generally, it is not easy to set the spacing between the rollers 47 and 53 at a fixed value and maintain such spacing. If the spacing is too small, the adhesive agent on the back of the label 7 tends to be rubbed against the large diameter roller or pressed out of the outer periphery of the label 7. Because of the viscous nature of the adhesive agent pressed out or transposed to another part, if it adheres to, e.g., the guide plate 41, it will interfere with the smooth transfer of the label 7. According to this embodiment, however, no such problem will arise.

While the embodiment shown in FIG. 9 has utilized the self-weight of the presser roller 53 to press it against the large diameter roller 47, separate springs (not shown) may be used to positively urge it against the large diameter roller with a suitable pressure.

Figure 10:
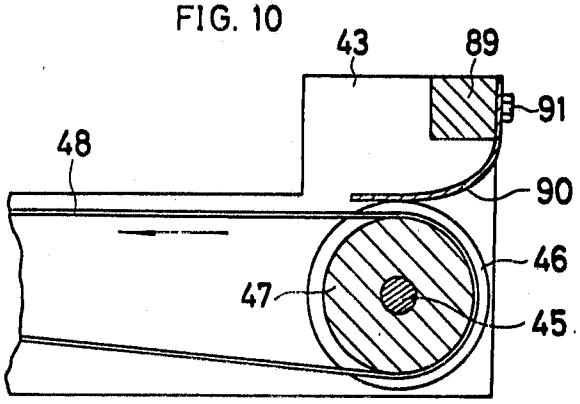

Referring to FIG. 10, the presser roller 53 may be replaced by a transverse bar 89 installed between the two frames 43 (only one of which is shown) and a plate spring 90 fixed to said transverse bar by screws 91, with the front end of said plate spring 90 urged against the top of the large diameter roller 47. In this embodiment also, substantially the same advantage as in the embodiment shown in FIG. 9 is obtained.

Figure 11:
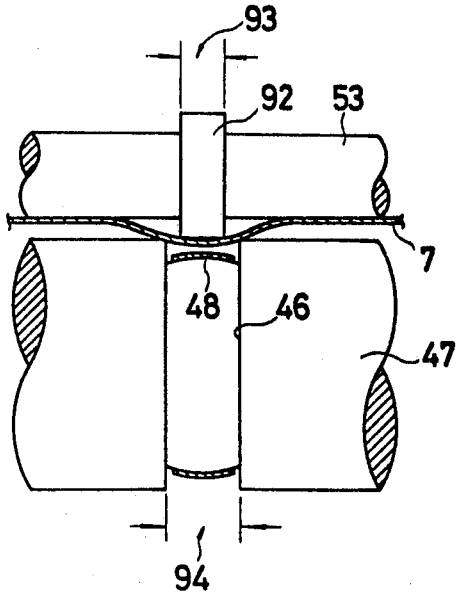

Referring to FIG. 11, the peripheral surface of the presser roller 53 is formed with annular projections 92 at places opposed to the annular grooves 46 of the large diameter roller 47. The width 93 of the annular projections 92 is smaller than the width 94 of the annular grooves 46, and the outer peripheral surface of the annular projections 92 is substantially flush with the outer peripheral surface of the large diameter roller 47. Further, the bottom surface of each annular groove 46 is crowned to prevent the belt 48 from shifting sideways.

With the arrangement described above, the label 7 inserted between the presser roller 53 and the large diameter roller 47 is bent at places opposed to the annular projections 92 and annular grooves 46 in such a manner that the front surface of all portions of the label 7 except those thus bent contacts the presser roller 53 and that the back surface of the label having the adhesive agent applied thereto does not substantially contact the large diameter roller 47. Therefore, the adhesive agent seldom adheres to the large diameter roller 47 and even if it does, it will not be transposed to the presser roller 53. Further, since the rollers 47 and 53 are arranged to grip the label 7 therebetween by bending it between the annular grooves 46 and annular projections 92, it is possible to transfer the label 7 while sufficiently gripping the same without requiring so accurate adjustment of the spacing between the rollers 47 and 53.

Figure 12:
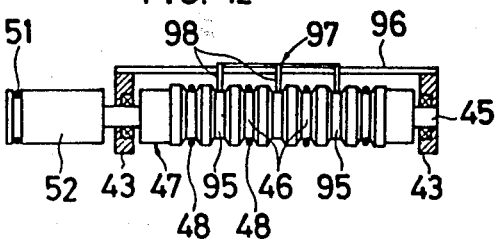

Referring to FIG. 12, the large diameter roller 47 is formed with three second annular grooves 95 each between adjacent ones of the four annular grooves 46 already provided for entraining the belts 48 thereabout. A transverse bar 96 is installed between the frames 43 and a plate spring 97 is fixed thereto. The plate spring 97 is formed with three legs 98 each inserted in one of said second annular grooves 95, with some clearance maintained between the front end of each leg 98 and the bottom surface of the associated annular groove 95.

With such arrangement, the label 7 is inserted between the large diameter roller 47 and the spring plate 97. Since the front ends of the legs 98 of the spring plate 97 are inserted in the annular grooves 95, the label 7 thus inserted is urged against the large diameter roller 47. Therefore, the label 7 is positively transferred by the large diameter roller 47 rotating at high speed. Further, since the front ends of the legs 98 are not contacted with the bottom surfaces of the annular grooves 95, the adhesive agent on the back of the label does not substantially adhere to the bottom surfaces of the annular grooves 95. Even if it adheres to such bottom surface, it will never be transposed to the front ends of the legs 98. Further, since such presser member composed of the plate spring 97 does not contact the large diameter roller 47, there is no danger of the surface of the large diameter roller 47 wearing out under the action of said presser member.

Figure 13:
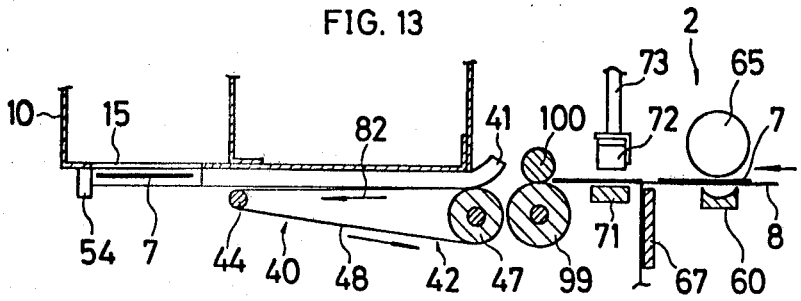

In the various embodiments described above, the function of snatching labels fed from the label issuing machine 2 has been imparted to the large diameter roller 47 which forms the initial end of the belt conveyor 42. An embodiment to be described now is provided with members which perform such function. Referring to FIG.13, a pair of snatching rollers 99 and 100 are installed ahead of the belt conveyor 42. The particular arrangements adopted in the large diameter roller 47 and presser roller 53 shown in FIGS. 9, 10 and 11 may preferably be used in this pair of snatching rollers 99 and 100.

Figure 14:
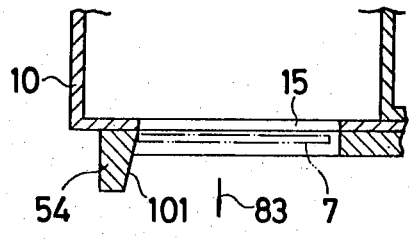
Figure 15:
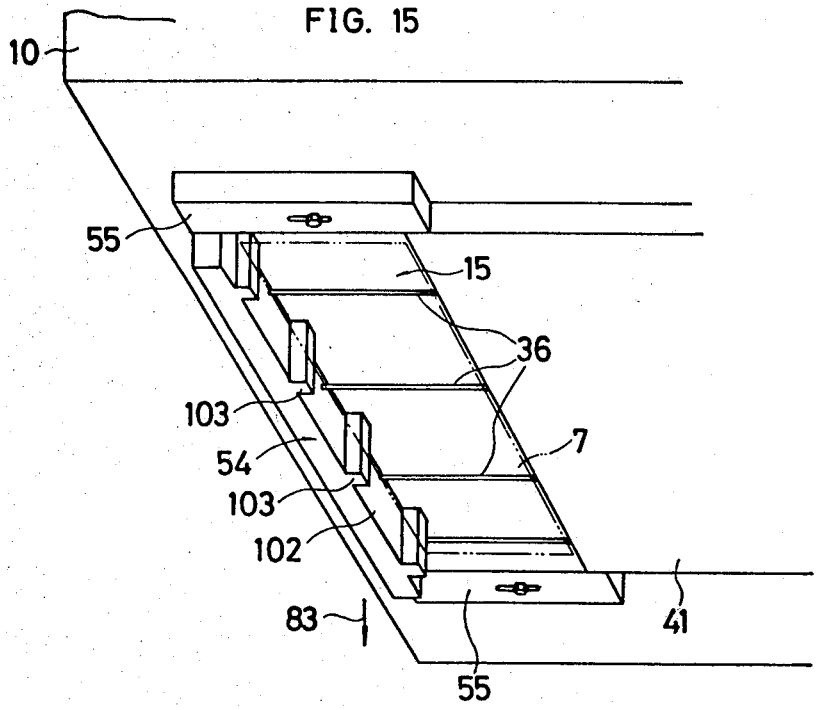

FIGS. 14 and 15 illustrate other embodiments of arrangements associated with the label retaining port 15 of the label sticking device 9.

Referring to FIG. 14 showing a sectional view of the label retaining port 15, a stop 54 for positioning the label 7 is associated with the label retaining port 15 and has an abutment surface 101 for the end edge of the label 7. The abutment surface 101 is gradually diverging in a direction 83 in which the label 7 flies toward the article 6 (not shown). Such arrangement has been adopted for the following reason.

The label sucked and retained at the label retaining port 15 is positioned at this place with its edge abutting against the abutment surface 101 of the stop 54. However, when it is desired to fly the label 7 in the direction of arrow 83 by supplying a blowing air current to the label retaining port 15, said abutting at least forms an impediment to the flight. If, therefore, the abutment surface 101 is sloped, the label 7 can be made independent of the stop 54 as soon as it starts flying from the label retaining port 15, so that it can fly in a straight line to the article 6. In addition, such arrangement of the stop 54 having the abutment surface 101 may be adopted also for the positioning plates 55 (FIG. 8).

Referring to FIG. 15 showing a perspective view of a principal portion looking at the label retaining port 15 from below, that surface 102 of the stop 54 provided in connection with the label retaining port 15 which is opposed to the label 7 is formed with a plurality of ridges 103 extending in a vertical direction (i.e., the direction of flight indicated by the arrow 83 in which the label 7 flies to the article 6). Therefore, upon reaching the label retaining port 15, the label 7 will abut against the ridges 103 on the stop 54.

The purpose of providing said ridges 103 is to enable the label 7 to fly in a straight line in the direction of arrow 83 as in the case of FIG. 14. The arrangement of FIG. 15 provides against the fact that the adhesive agent applied to the back of the label 7 tends to spread to the outer peripheral edge of the label 7. Such spreading of the adhesive agent has already taken place despite the face that the label 7 is retained on the backing strip 8, and said spreading is made more noticeable when the label is pressed between the large diameter roller 47 and the presser roller 47 in the label transfer device 40. Such spreading of the adhesive agent will result in the label 7 temporarily adhering to the stop 54 despite the arrangement wherein only one end edge of the label 7 contacts the stop 54. However, the provision of the ridges 103 greately reduces the area of contact with one end edge of the label 7, thereby substantially eliminating said phenomenon of adhesion which would cause the label 7 to be caught by the stop 54 and thereby interfere with the proper flight of the label 7. In this sense it is preferable that the width of the ridges 103 be as small as possible and that the material of which they are made be one which it is difficult for the adhesive agent to adhere, e.g., a silicone type resin.

In addition, if the following consideration is given to the disposition of the ridges 103, desirable results will be obtained: The label 7 does not contact the large diameter roller 47 at the places where the annular grooves 46 exist, so that at said places it is possible to minimize the spreading of the adhesive agent. If, therefore, the width of the ridges 103 is made smaller than the width of the annular grooves 46 and the ridges 103 are located on extensions of the annular grooves 46, then the ridges 103 receive those portions of the outer peripheral edge of the label 7 where least spreading has occured. It will be understood that such arrangement is most preferable to eliminating the phenomenon of adhesion described above.

Figure 16:
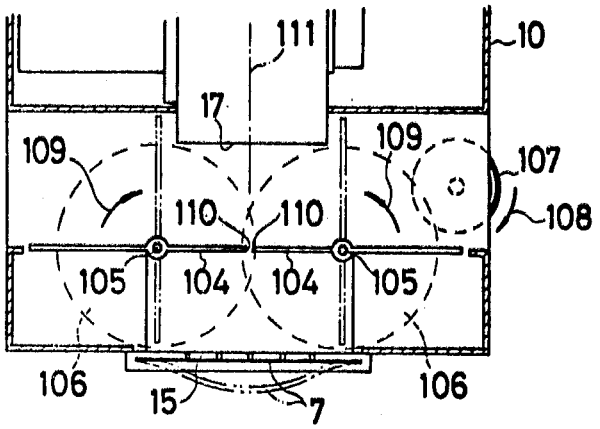
FIGS. 16 through 18 are sectional views of principal portions illustrating other embodiments of arrangements associated with the gate means of the sticking device portion.
Figure 17:
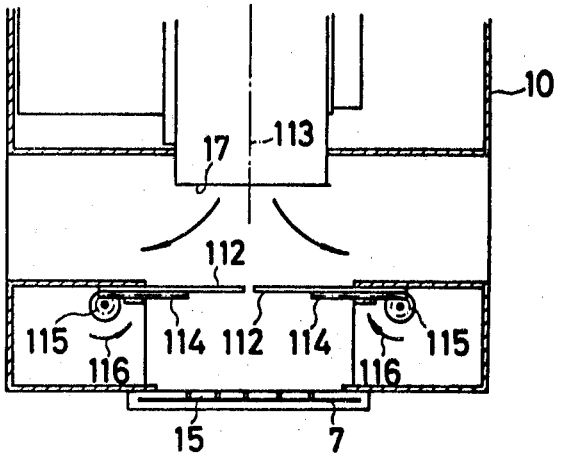
Figure 18:
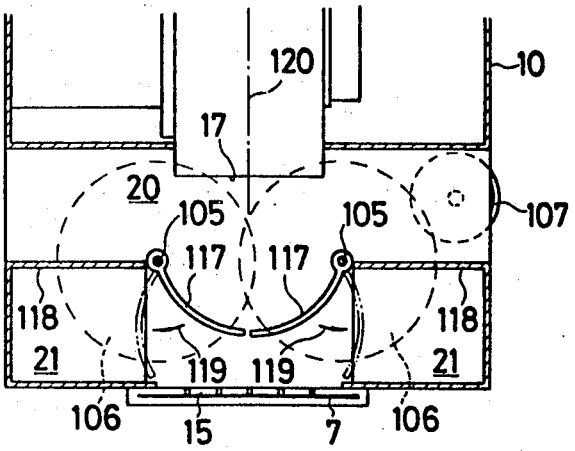

FIGS. 16 through 18 are sectional views of principal portions illustrating other embodiments of arrangements associated with the gate means included in the label sticking device 9.

As best shown in FIG. 5 previously described, the pair of gates 19 for opening and closing the air blowing path are operable for opening and closing in a symmetrical manner. More particularly, the gates 19 are so arranged as to establish a path closing state in which their opposed front ends are positioned at the center of said blowing path and a path opening state in which their front ends are positioned equidistantly from the center of the path. Therefore, when the gates 19 are turned to open the air blowing path, the air being blown from the blowing port 17 of the fan box 16 toward the label retaining port 15 first hits the middle of the label 7 and then gradually spreads toward the periphery. Consequently, the middle of the label 7 is first downwardly curved to leave the retaining port 15 and then its opposite ends leave the retaining port 15, so that the label 7 can fly in a straight line toward the article 6. Such gates operable for opening and closing in said symmetrical manner may also be arranged as follows.

Referring to FIG. 16, gates 104 shown therein are fixed on rotary shafts 105, so that they can be rotated when the shafts 105 are rotated. Fixed on the rotary shafts 105 are large gears 106 meshing with each other. A small gear 107 is meshing with one of the large gears 106. Therefore, when the small gear 17 is rotated from the state shown in FIG. 16 in the direction of arrow 108 as by a drive motor (not shown), the gates 109 are rotated in the direction of arrows 109 through the large gears 106 and shafts 105, with the respective front ends 110 of the gates 104 moving away from the center line 111 the same distance at any instant during the rotation. In addition, FIG. 16 shows in phantom lines the label 7 retained at the label retaining port 15, which is about to make a flight.

Referring to FIG. 17, a pair of gates 112 are horizontally movable toward and away from the center line 113. The gates 112 have racks 114 fixed thereto, and pinions 115 meshing with said racks 114 are rotatably installed on the fixed side. With this arrangement, when the pinions 115 are rotated in the directions of arrows 116, the gates 112 are equidistantly moved away from the center line 113.

Referring to FIG. 18, a pair of arcuate gates 117 are provided. The driving mechanism for the gates 117 is the same as that shown in FIG. 5, and includes rotary shafts 105, large gears 106 and a small gear 107. Fixed partition walls 118 are provided for separating the upper and lower chambers 20 and 21 from each other, and by utilizing said fixed partition walls 118, the rotary shafts 105 are installed. The function obtained by such arrangement is substantially the same as in FIG. 16 in that the gates 117 are rotated in the directions of arrows 119 through the small gear 107, large gears 106 and rotary shafts 105, with the front ends of said gates 117 equidistantly moving away from the center line 120.

In the foregoing the preferred embodiments of the inventive label handling apparatus were described, centering on the mechanical aspect. In the following, therefore, several preferred embodiments of electrical control means for adaptable combination with such mechanical implementation for achieving an advantageous operation thereof.

Figure 19:
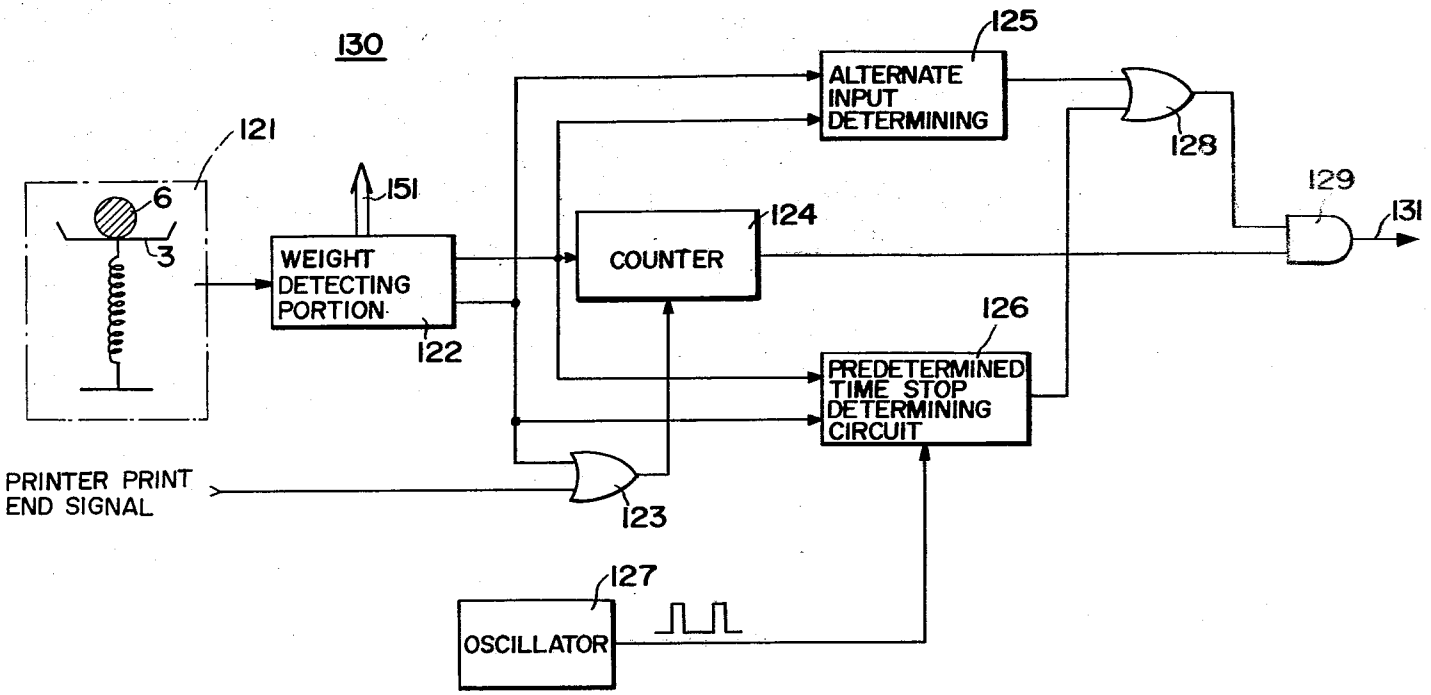
FIG. 19 is a schematic block diagram illustrating a weighing circuit.

FIG. 19 shows a block diagram of a weighing circuit 130 including the weighing pan 3. Such weighing circuit 130 is well known to those skilled in the art and therefore the structure and the operation thereof will be described in conjunction with the present invention. The weighing portion 130 comprises the weighing mechanism 121 having the weighing pan 3 for placing an article 6 as shown in FIG. 1. Although not shown in detail, the weighing mechanism 121 comprises a plate having slits which is displaceable in association with the displacement of the weighing pan 3. A photosensor, for example, is provided to be faced to a plurality of slits formed on the plate. The photosensor serves to provide a pulse output responsive to each slit as the weighing pan 3 is displaced and thus the slits formed on the plate are displaced. More specifically, the weighing mechanism 121 serves to convert a mechanical displacement amount of the weighing pan 3 to a train of electrical pulses the number of which is associated with the displacement amount. The pulse train is applied to a weight detecting portion 122. The weight detecting portion 122 comprises means for detecting whether a given electrical pulse train is an addition pulse or a subtraction pulse and a reversible counter for making an adding or subtracting count responsive to an addition or subtraction pulse, respectively. Accordingly, when an article 6 is placed on the weighing pan 3 of the weighing mechanism 121, the counter included in the weight detecting portion 122 counts the pulses number of which is associated with the weight thereof. If the pulse is adapted to be associated with a given unit weight, then the weight value of the article can be obtained as a function of the number of pulses and the unit weight. The said weight value is applied to the line printer 64 included in the label issuing machine 2 as the data being printed on the label 7. It is needless to say that the line printer 64 is also supplied simultaneously with other data concerning the price of the article 6 associated with the said weight value in addition to the said weight value.

The addition pulse as detected by the weight detecting portion 122 is applied to a counter 124, an alternate input determining circuit 125 and a predetermined time stop determining circuit 126 in the succeeding stage, while the subtraction pulse as detected by the weight detecting portion 122 is applied to an OR gate 123, the said alternate input determining circuit 125 and the said predetermined time stop determining circuit 126. The counter 124 is aimed to detect whether a new article is placed on the weighing pan 3 after the preceding label issuance and is adapted to be cleared by either the subtraction pulse obtained from the weight detecting portion 122 or a print end signal obtained from the line printer 64. The counter 124 may be, for example, a present counter, wherein a count up signal is obtained when a preset number, say 15, is counted. The count up signal obtained from the counter 124 is applied to an AND gate 129 as one input thereto.

Both the alternate input determining circuit 125 and the predetermined time stop determining circuit 126 serve to determine whether the weighing pan 3 of the weighing mechanism 121 has reached a balanced or stable state. More specifically, the alternate input determining circuit 125 is structured to be responsive to an alternate input state of the addition pulse and the subtraction pulse to determine a balanced state of the weighing mechanism 121. More specifically, use is made of the fact that when the weighing pan 3 is about to reach a balanced state the addition pulse and the subtraction pulse come to be alternately received, while both converge in turn to a stable state. Accordingly, the alternate input determining circuit 125 is structured such that an output is provided upon detection of one of the addition signal and the subtraction signal being received which is then followed by the other signal. The output of the alternate input determining circuit 125 is applied to an OR gate as one input thereto. The predetermined time stop determining circuit 126 is aimed to detect a stable state of the weighing mechanism 121 and is structured to provide an output when neither the addition pulse nor the subtraction pulse is received from the weight detecting portion 122 during one cycle period of the pulse obtained from an oscillator 127 corresponding to say 200 msec. The output of the predetermined time stop determining circuit 126 means that the weighing pan 3 has reached a stable state. The output of the predetermined time stop determining circuit 126 is applied to the OR gate 128 as the other input thereto. Accordingly, the OR gate 128 provides an output whenever the weighing pan 3 has reached either a quasi-stable state or a stable state. The output of the OR gate 128 is applied to the AND gate 129 as the other input thereto.

The AND gate 129 is connected to receive the count up output from the counter 124, as described previously. If and when an article 6 is placed on the weighing pan 3, the output from the counter 124 becomes the high level and if and when the weighing pan 3 becomes close to a balanced state or a stable state or reaches a balanced state or a stable state in such a situation then the AND gate 129 provides a balance signal 131. A more detailed description concerning such weighing circuit is seen in, for example, U.S. Pat. No. 4,102,421, issued July 25, 1978 to the same assignee as the present invention.

Figure 20:
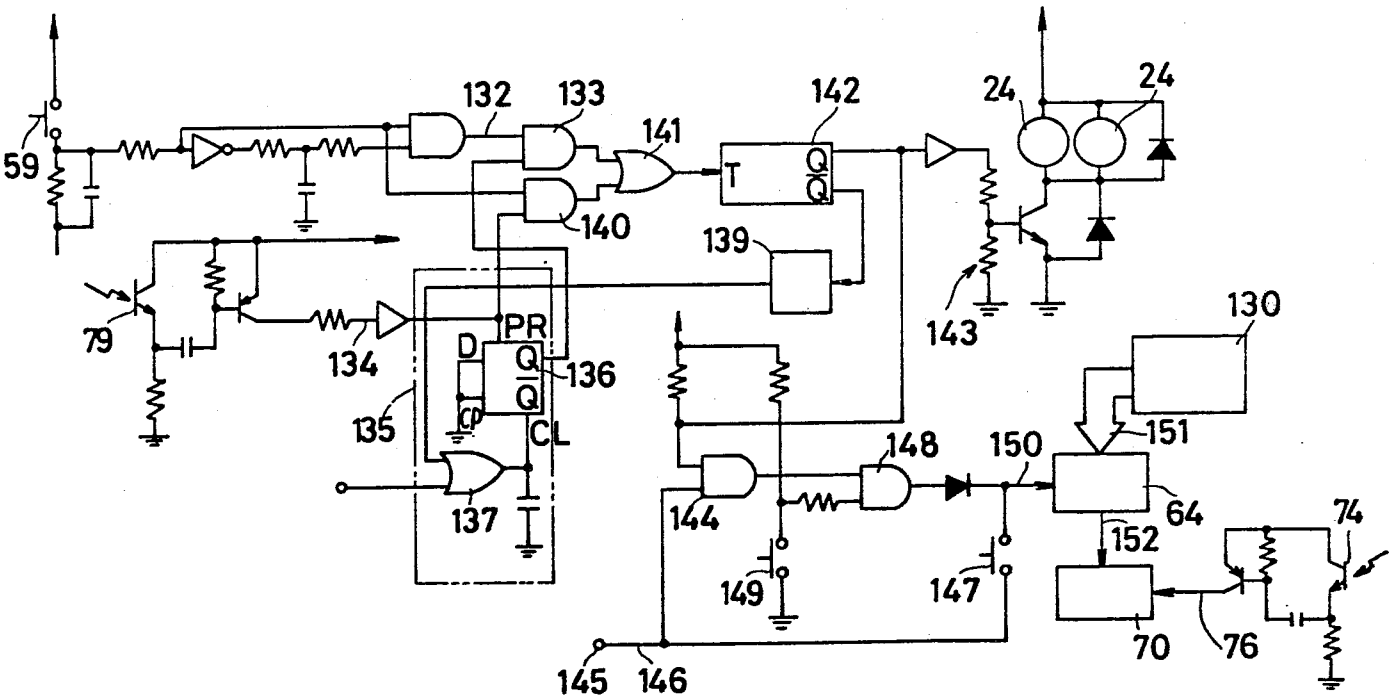
FIG. 20 is a circuit diagram illustrating an example of a control circuit for controlling the issuing of labels.

FIG. 20 shows a schematic diagram of one example of a control circuit for controlling label issuance. More specifically, the control circuit shown is structured to be responsive to a detected signal from the light emitting part 79 and the signal from the limit switch 59 shown in FIGS. 3 and 5 to achieve intermittent feed by means of the motor 68 of the intermittent feed device 70 (see FIG. 6) in the line printer 64 and on/off control of the solenoids 24 in FIG. 3. The limit switch 59 generates the output of the high level when the same is turned on and the output signal 132 is applied to the AND gate 133 as one input thereto. The passage detected signal 134 from the light receiving part 79 is applied to a flip-flop 136 constituting a holding circuit 135 as a set input thereto. The holding circuit 135 further comprises an OR gate 137, the output of which is applied to the flip-flop 136 as a clear input thereto. The OR gate 137 is also connected to receive the output of a monostable multivibrator 139. The output Q of the flip-flop 136 is applied to the other input of the above described AND gate 133. On the other hand, the output signal 132 of the switch 59 and the passage detected signal 134 from the light receiving part 79 are both applied to an AND gate 140. The output of the AND gate 133 and the output of the AND gate 140 both are applied through an OR gate 141 to the trigger input of a monostable multivibrator 142. The monostable multivibrator 142 comprises a retriggerable monostable multivibrator having a predetermined output time, say 100 msec., which is retriggered responsive to each trigger input to provide the output Q of the high level. The above described monostable multivibrator 139 is adapted to be triggered responsive to the output $\overline{Q}$ of the monostable multivibrator 142. The output Q of the retriggerable monostable multivibrator 142 is applied to a switching circuit 143 as an on/off control signal, while the same output Q of the monostable multivibrator 142 is applied to an AND gate 144 as one input thereto. The switching circuit 143 comprises a switching transistor, for example, to energize or deenergize the above described solenoids 24.

The AND gate 144 is connected to receive a clock signal from a terminal 145. The clock signal 146 is applied to a label issuing switch 147 provided on the operating panel 4, shown in FIG. 1, so as to be manually operable. The label issuing switch 147 is aimed to manually instruct label issuance by the line printer 64 irrespective of the state of the above described monostable multivibrator 142 and is utilized to issue the label of the same contents, for example. The output of the AND gate 144 serves as a print command signal for the line printer 64 and is applied to an AND gate 148 as one input thereto. The other input of the AND gate 148 is connected to an end switch 149. The end switch 149 is provided on the operating panel 4 shown in FIG. 1, for example, so as to be manually operable and is used as a manual switch for commanding the end of label issuance. The output of the AND gate 148 and the output of the label issuing switch 147, i.e. the clock signal 146 are both applied to the line printer 64 in a wired OR manner.

Figure 21:
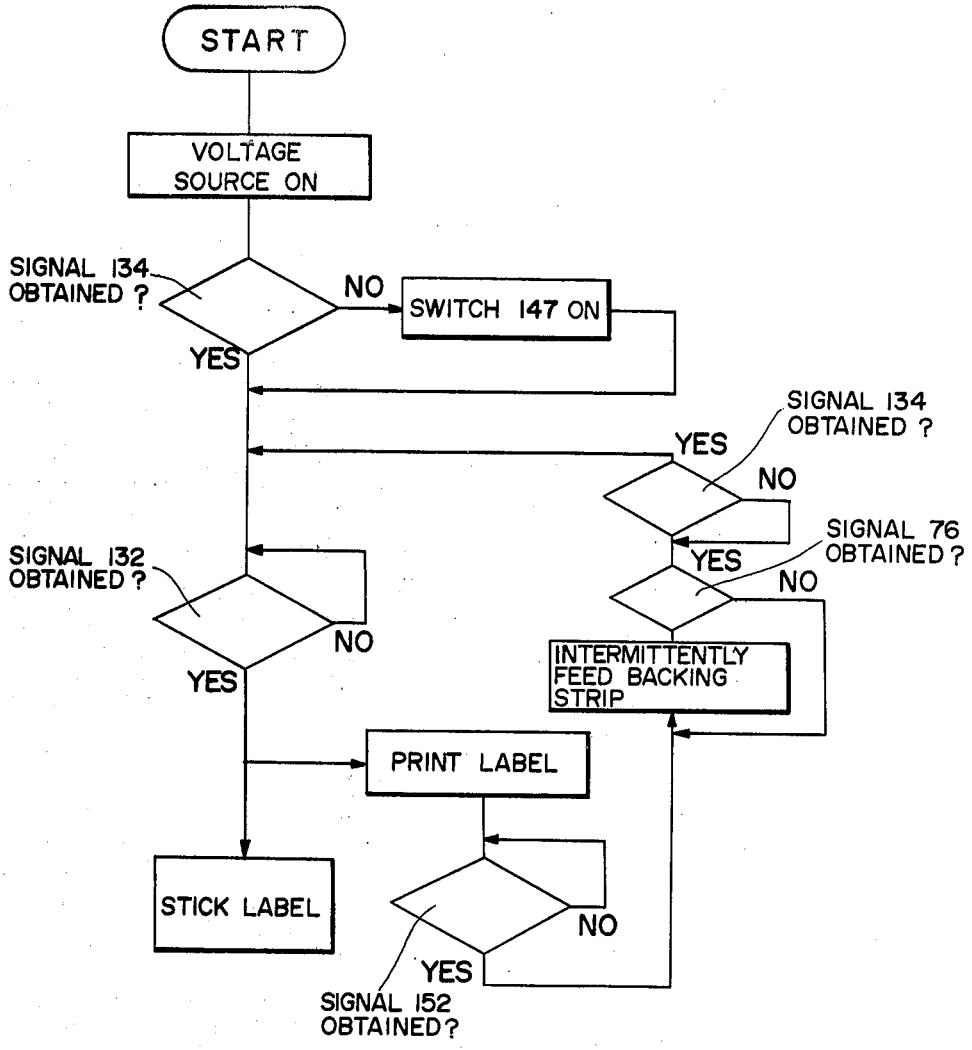
FIG. 21 is a flow diagram associated with FIG. 20.

The line printer 64 is also supplied with the printing data 151 from the weighing circuit 130 as shown in FIG. 19. The line printer 64 is responsive to termination of the printing operation to provide a print end signal 152 to the intermittent feed device 70. The intermittent feed device 70 is supplied with a signal 76 from a light receiving part 75, which is obtained from the light receiving part 75 upon detection of the spacing between the adjacent labels shown in FIG. 2, for example. More specifically, the intermittent feed device 70 may be structured such that the same is responsive to the print end signal 152 to energize the motor 68 and is responsive to the signal 76 to deenergize the motor 68. Since the structural features were described in the foregoing, an operation thereof will be described in the following with reference to a flow diagram in FIG. 21 and timing diagrams in FIGS. 22 and 23.

Figure 23:
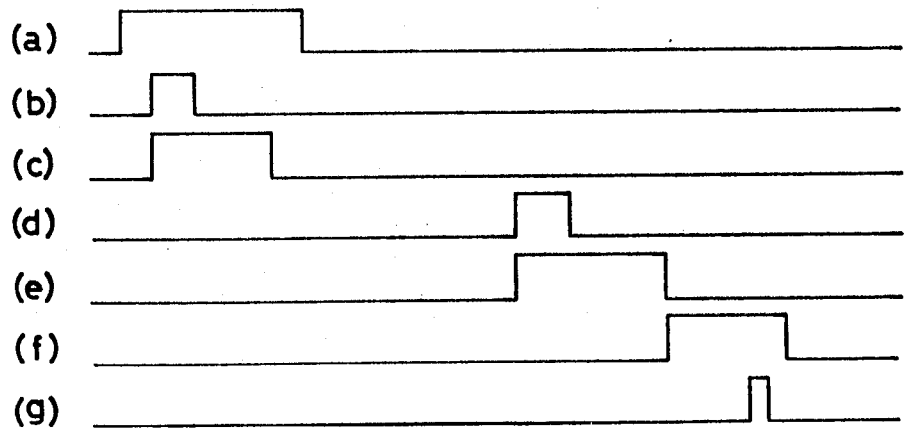

At the outset, description will be made of an operation in a normal printing state, i.e. an operation in case where the end switch 149 has not been turned on. At the beginning of the operation, i.e. immediately after the power supply is turned on, a label 7 has not been retained at the label retaining port 15 shown in FIG. 6, for example. When the label issuing switch 147 is operated to be turned on (see FIG. 23(*d*)) in such a situation, a print command is applied to the line printer 64 at the timing of the clock signal 146 obtained from the terminal 145. Accordingly, the line printer 64 prints the data 151 from the weighing circuit 130 and a prescribed item such as the date and the like (see FIG. 23(*e*)). The line printer 64 provides the print end signal 152 after the end of the printing operation. Accordingly, the motor 68 (see FIG. 6) of the intermittent feed device 70 is energized. Therefore, as shown in FIG. 23(*f*), the backing strip 8 is fed by a prescribed pitch at the speed of 70 mm/sec., for example, by means of the intermittent feed device 70. More specifically, the intermittent feed device 70 is enabled responsive to the print end signal 152 and is disabled responsive to the signal 76, with the result that the backing strip 8 is intermittently transferred by a prescribed pitch commensurate with the length of one label, for example. Therefore, the label 7 as printed is peeled off from the backing strip 8 and is fed to the guide table (printing table) 71. Then the printing plate 72 is pressed on the label 7 as fed on to the printing table 71, whereby the article name is printed. Thereafter the said label 7 comes to be sandwitched by the press roller 53 and the large diameter roller 47, whereupon the label 7 is transferred to between the belt conveyor 42 which has been driven at the high speed, say 100 m/minute, by means of the drive motor 49 and the guide plate 41 and is transferred in the direction as shown by the arrow 82 in FIG. 6 and is further fed to the label retaining port 15 through underneath opening 77.

When the label is fed above the belt conveyor 42, the label is detected by the light receiving part 79. Accordingly, the passage detected signal 134 as shown in FIG. 23(*g*) is obtained from the light receiving part 79. Therefore, the flip-flop 136 in the holding circuit 135 is set, whereby the output Q turns to the high level.

The label 7 as fed to the label retaining port 15 is sucked toward the label retaining bars 36 (FIG. 8) and is retained thereby by means of an airstream the direction of which is shown by the arrow in FIG. 6.

Figure 22:
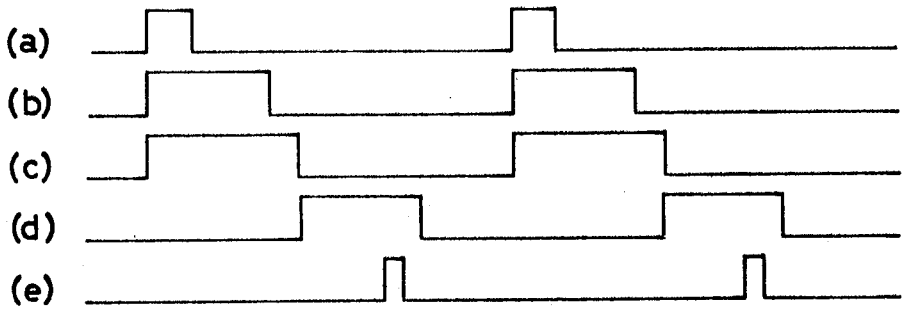
FIGS. 22 and 23 are timing diagrams.

When the article 6 is then pressed toward the reference surface 58 of the positioning device 56 as shown in FIG. 5, for example, the stick start switch i.e. the limit switch 59 detects the same, whereby the output signal 132 as shown in FIG. 22(*a*) is obtained from the switch 59. Accordingly, two inputs to an AND gate 133 become the high level to provide the output therefrom, which output is applied through the OR gate 141 to the monostable multivibrator 142, thereby to trigger the same. When the monostable multivibrator 142 is triggered, the output Q thereof becomes the high level and the switching circuit 143 is turned on, whereby the solenoids 24 are energized as shown in FIG. 22(*b*). Upon energization of the solenoids 24, the plungers 25 are pulled upward, whereby the gates 19 are brought from a horizontal state to an upright state. Accordingly, the blowing port 17 of the fan box 16 comes to communicate with the label retaining port 15, whereby the retaining operation of the label retaining port 15 is changed to a sticking operation. When the label retaining port 15 comes to communicate with the blowing port 17, the label as retained on the label retaining bars 36 is caused to fly toward the placed article 6 in the direction of the arrow 83, with the result that the label is stuck to the article 6.

On the other hand, when the output Q of the monostable multivibrator 142 turns to the high level, the output $\overline{Q}$ thereof turns to the low level, whereby the monostable multivibrator 139 is triggered. Accordingly, the high level output of a predetermined time period obtainable from the monostable multivibrator 139 resets the flip-flop 136 in the holding circuit 135. At the same time, the output Q of the high level obtained from the monostable multivibrator 142 is also applied to the AND gate 144. Therefore, the AND gate 144 provides a print command for the following label to the line printer 64 through the AND gate 148 at the timing of the clock 146 applied to the terminal 145, because the end switch 149 has been turned off. Thus, the line printer 64 achieves the above described printing operation (FIG. 22(*c*)). When the printing operation is completed, the signal 152 is applied to the intermittent feed device 70. Therefore, the intermittent feed device 70 makes an intermittent feed operation as shown in FIG. 22(*d*). More specifically, as described previously, the motor 68 is turned on responsive to the signal 152 and is turned off responsive to the signal 76. Accordingly, the label as printed is again fed to the label retaining port 15 by means of the belt conveyor 42. At that time, the flip-flop 136 is again set responsive to the passage detected signal 134 obtained from the light receiving part 79, to be ready for operation of sticking the following label to be initiated upon turning on of the limit switch 59. With such structure, during a time period after the article 6 is pressed on the reference surface 58 of the positioning device 56 and the label is stuck until the following article is again pressed on the reference surface 58, the following label is kept retained on the label retaining port 15, which makes it possible to achieve a successive label sticking operation, with the result that the operational performance and the efficiency are enhanced.

Now description will be made of an operation in case where the end switch 149 is operated. When the end switch 149 is turned on, as shown in FIG. 23(*a*), one input to the AND gate 148 becomes the low level. Assuming that thereafter the article 6 is pressed on the reference surface 58 as described previously and the limit switch 59 is turned on as shown in FIG. 23(*b*), then the high level output is obtained from the monostable multivibrator 142 as shown in FIG. 23(*c*), as described previously, whereupon the solenoids 24 are energized and the label is stuck. However, since the AND gate 148 has been disabled by means of the end switch 149, the clock signal 146 from the AND gate 144 that receives the output of the monostable multivibrator 142 is disabled and is not applied to the line printer 64 as a print command. Accordingly, the printing and intermittent feed operation for the following label as shown in FIGS. 23(*e*) and (*f*) and described previously is not effected. Therefore, when a label is to be stuck on the final article, any further unnecessary label is prevented from being printed by operating the end switch 149 in advance. Therefore, even in case where labels of different printing items are to be stuck subsequently, any further unnecessary label is not retained on the label retaining port 15 and any erroneous sticking operation is prevented.

Figure 24:
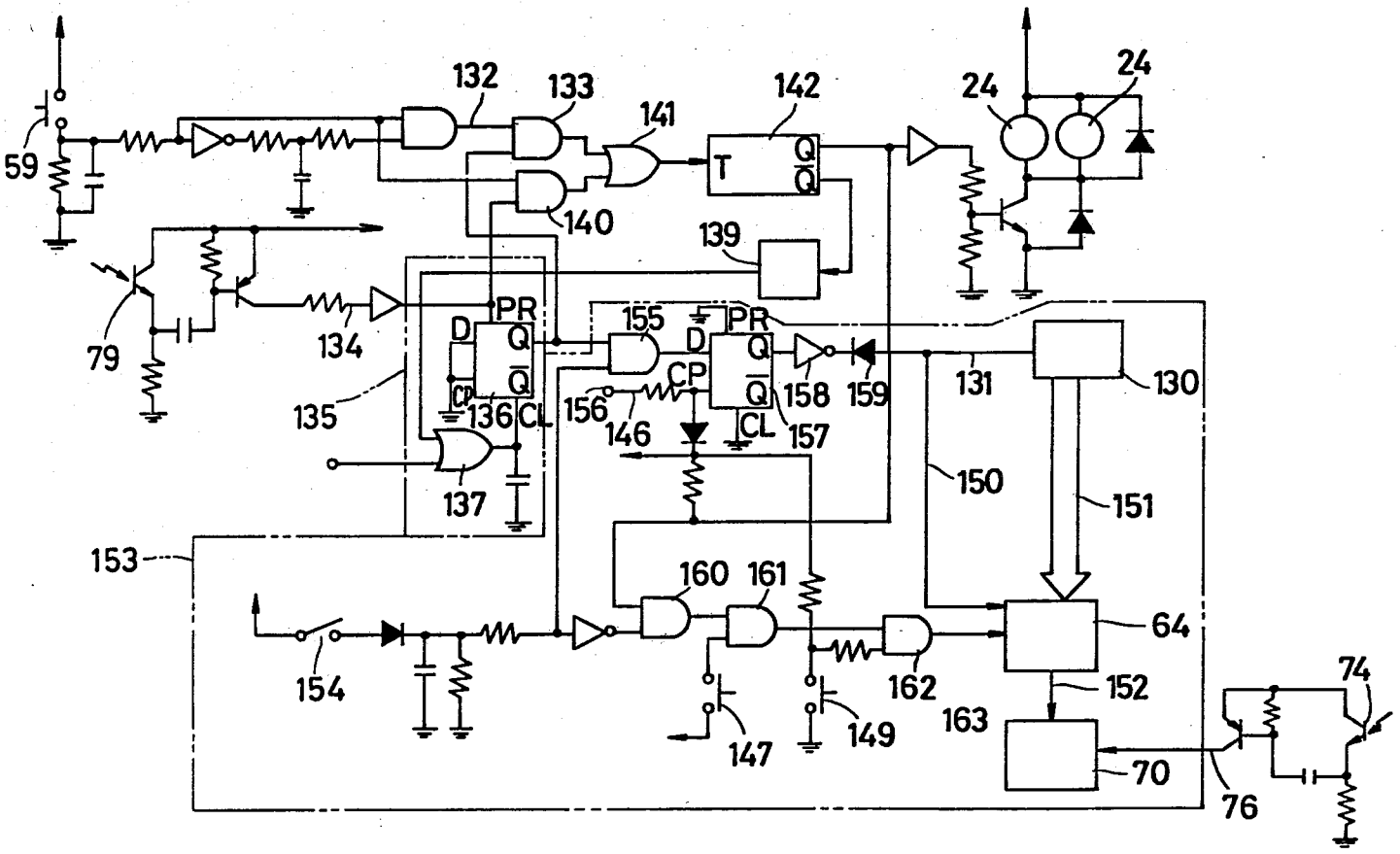
FIG. 24 is a circuit diagram illustrating another embodiment of a control circuit of the invention.

FIG. 24 shows a schematic diagram of another embodiment of the inventive control circuit. The embodiment shown is different from the FIG. 20 embodiment in the block 153 as enclosed by the two dotted line in FIG. 24. Therefore, in the following description, the FIG. 24 embodiment will be described with some emphasis on the block portion 153. The embodiment shown is characterized by utilization of a balance signal 131 from the weighing circuit 130 for the purpose of the above described control. To that end, a selection switch 154 is provided on the operating panel 4 shown in FIG. 1. The selection switch 154 is aimed to select the normal printing operation responsive to the balance signal 131 from the above described weighing circuit 130 and the manual printing operation responsive to the operation of the label issuing switch 147. Turning on of the selection switch 154 selects the normal printing operation, thereby to provide the high level output. The output signal from the selection switch 154 and the output Q of the flip-flop 136 in the holding circuit 135 are applied to an AND gate 155 as an input thereto. The output of the AND gate 155 is applied to the input of a flip-flop 157. The flip-flop 157 is connected to receive at the clock terminal the clock signal 146 obtained from a terminal 156. The output of the flip-flop 157 is connected to the cathode of a diode 159 through an inverter 158. The anode of the diode 159 is supplied with the balance signal 131 obtained from the above described weighing circuit 130 and the anode of the diode 159 is also connected to the print command input of the line printer 64.

Figure 25:
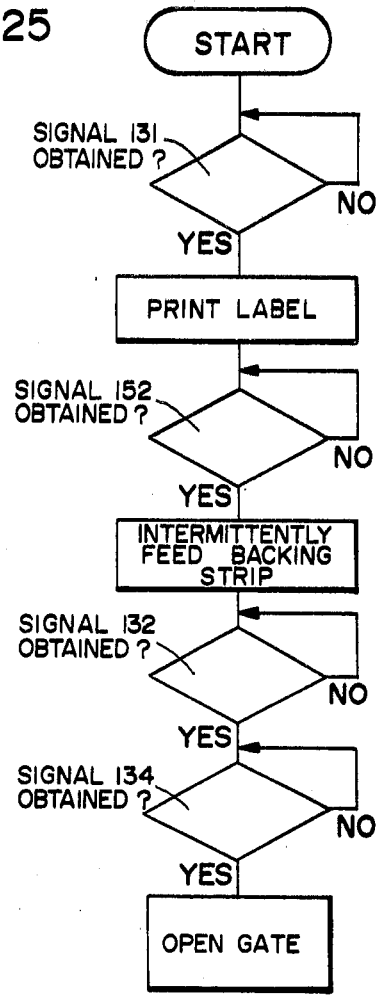
FIG. 25 is a flow diagram associated with FIG. 24.

On the other hand, the output Q of the retriggerable monostable multivibrator 142 defining the on period of the solenoids 24 and an inversion of the output of the selection switch 154 are applied to an AND gate 160. The output of the AND gate 160 and the output of the label issuing switch 147 are applied to an AND gate 161. The output of the AND gate 161 and the output of the end switch 149 are applied to an AND gate 162. The output of the AND gate 162 is applied to the line printer 64 as a print inhibiting signal 163 for inhibiting the printing operation by the printer 64. The line printer 64 is supplied with the printing data 151 from the weighing circuit 130, and the intermittent feed device 70 is supplied with the print end signal from the line printer 64 and the signal 76 from the light receiving part 75, as described previously. Since the structural features of the embodiment were described in the foregoing, a series of operations will be described in the following with reference to a flow diagram in FIG. 25 and a timing diagram in FIG. 26.

Now description will be made of the normal printing operation mode or the automatic printing operation mode which is of most interest in the embodiment shown. For the purpose of placing the machine in the normal printing operation, the selection switch 154 is turned on. Accordingly, the high level signal is obtained from the selection switch 154, which is applied to the AND gate 155 as one input thereto. At the same time, the high level signal is inverted and is applied to the AND gate 160, so that the output from the AND gate 162, i.e. the print inhibiting signal 163 is the high level.

Immediately after the power supply is turned on, no label as printed exists on the belt conveyor 42 and accordingly no detected signal is obtained from the light receiving part 79. Therefore, the flip-flop 136 of the holding circuit 135 remains reset and accordingly the output Q therefrom remains the low level. Accordingly, the output of the AND gate 155 remains the low level and the flip-flop 157 is not set. Therefore, the output Q of the flip-flop 157 is the low level and the output of the inverter 158 is the high level. Therefore, the diode 159 connected to the inverter has a higher potential at the cathode side, which keeps the diode 159 non-conductive.

Figure 26:
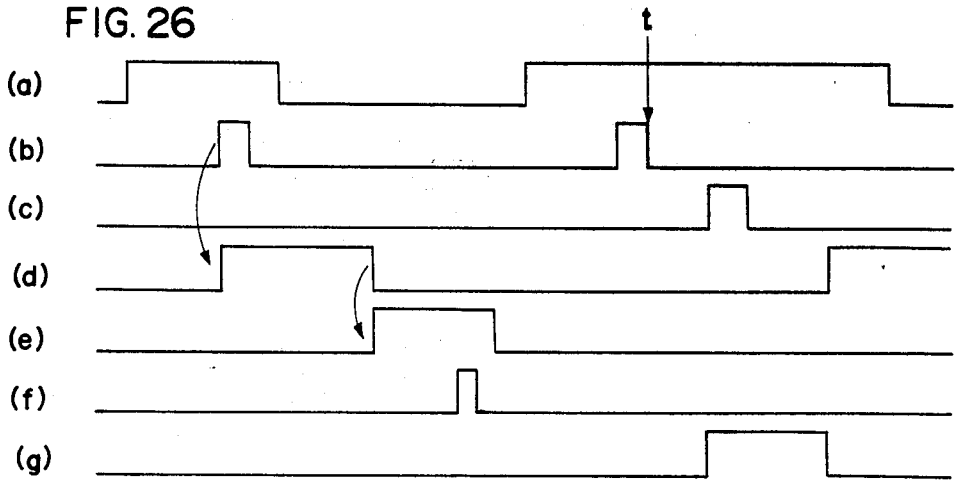
FIG. 26 is a timing diagram.

On the other hand, an article 6 to which a label is to be stuck is placed on the weighing pan 3 of the weighing mechanism 121 shown in FIG. 19 at the timing shown in FIG. 26(*a*). Then, the balance signal 131 is obtained at the timing shown in FIG. 26(*b*) from the weighing circuit 130, as described previously. Since at that time the diode 159 has been rendered non-conductive, as described previously, the balance signal 131 is applied to the line printer 64 as the print command signal 150. On the other hand, since the line printer 64 has been supplied with the printing data 151 from the weighing circuit 130, the line printer 64 prints the prescribed items on the label based on the data 151 (FIG. 26(*d*)). The intermittent feed device 70 is responsive to the print end signal 152 from the line printer 64 and the signal 76 from the light receiving part 75 to effect an intermittent feed operation of the backing strip, as shown in FIG. 26(*e*). Thus, the label as printed is transferred by the belt conveyor 42 to reach the label retaining port 15. At that time, the passage detected signal 134 is generated from the light receiving part 79, as shown in FIG. 26(*f*). The flip-flop 136 of the holding circuit 135 is responsive to the passage detected signal 134 to be set, whereby the output Q thereof becomes the high level.

Accordingly, the output of the AND gate 155 becomes the high level at that time and the flip-flop 157 is set. Therefore, the output Q of the flip-flop 157 becomes the high level and the output of the inverter 158 becomes the low level. Accordingly, the anode of the diode 159 becomes a low potential, whereby the diode 159 is rendered conductive in the forward direction.

Thereafter the article upon which the label is to be stuck is pressed to the reference surface 58 of the positioning device 56 and, when the limit switch 59 is turned on, the output signal 132 becomes the high level and the output of the AND gate 133 becomes the high level. Accordingly, the monostable multivibrator 142 is triggered and the output Q thereof becomes the high level, whereby the solenoids 24 are enabled and a label is stuck to the said article in the same manner as described previously.

Thereafter the output Q of the monostable multivibrator 142 becomes the high level and the flip-flop 136 in the holding circuit 135 is reset. Accordingly, the output Q of the flip-flop 136 and thus one input to the AND gate 155 becomes the low level. As a result, the output of the inverter 158 becomes the high level and the diode 159 is again rendered non-conductive. Accordingly, the balance signal 131 from the weighing circuit 130 can be applied again to the line printer 64 as a print command signal 150.

Meanwhile, it is seen from the timing chart shown in FIG. 26 that even if an article is loaded on the weighing circuit 130 and the balance signal 131 is obtained, during a time period after the label is detected by the light receiving part 79 until the solenoids 24 are enabled, i.e. after the label as printed is detected on the belt conveyor 42 until the label sticking operation is completed, no printing operation is effected responsive thereto. The reason is that when the passage detected signal 134 is obtained from the light receiving part 79 the output Q of the flip-flop 136 becomes the high level and the output of the flip-flop 157 also becomes the high level and thus the diode 159 is rendered conductive in the forward direction, as described previously. More specifically, even if the balance signal 131 is obtained from the weighing circuit 130 when the diode 159 is rendered conductive in the forward direction, the balance signal 131 is allowed to be fed to the inverter 158 through the conducting diode 159. Therefore, the print command signal 150, i.e. the balance signal 131 is not applied to the line printer 64.

For the purpose of issuing a label by means of the manual label issuing switch 147, the selection switch 154 is turned off. Accordingly, the flip-flop 157 is not set and the output of the inverter 158 remains the low level and hence the diode 159 remains conductive in the forward direction, as described previously. Accordingly, the balance signal 131 and thus the print command signal 150 is not obtained from the weighing circuit 130. On the other hand, the low level output from the switch 154 is inverted and is applied to the AND gate 160. Accordingly, if and when the other input to the AND gate 160, i.e. the output Q of the monostable multivibrator 142 becomes the high level, then the AND gate 161 is opened or enabled responsive to the output from the AND gate 160. Therefore, the clock signal 146 fed to the label issuing switch 147 is obtained through the AND gates 161 and 162 (the AND gate 162 is closed or disabled when the end switch 149 is turned on), whereby the print inhibiting signal 163 is brought to the high level at the timing of the said clock 146, with the result that the line printer 64 is supplied with a print command signal.

The operation of the end switch 149 is the same as the embodiment described with reference to FIG. 20. More specifically, when the end switch 149 is turned on, the AND gate 162 is closed or disabled, whereby the output thereof, i.e. the signal 163 remains the low level and the printing operation by the line printer 64, i.e. the label issuing operation, responsive to the balance signal 131, is prevented.

Figure 27:
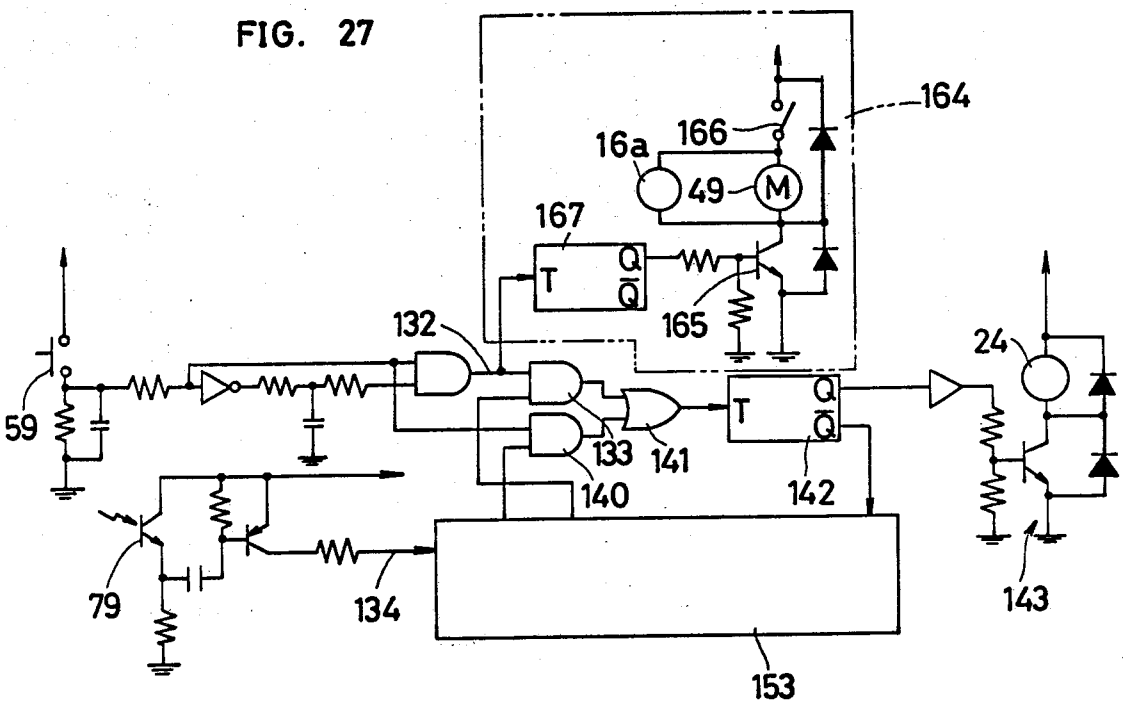
FIG. 27 is a circuit diagram illustrating a further embodiment of a control circuit of the invention.

FIG. 27 is a block diagram showing a further embodiment of the inventive control circuit. The embodiment shown comprises a circuit configuration 164 of interest to control of the drive motor 49 (see FIG. 6, for example) and the fan motor 16*a* included in the fan box 16. The remaining portions are substantially the same as those of the FIG. 24 embodiment. Accordingly, the block 164 will be specifically described in the following. As shown in the block 164, the apparatus shown in FIG. 1 comprises a door for maintenance, not shown, and a switch 166 is provided in a ganged fashion with the door. One contact of the switch 166 is connected to one end of each of the fan motor 16*a* and the drive motor 49 of the belt conveyor 42. The other end of each of these motors 16*a* and 49 is connected to the ground through a switching transistor 165. The other contact of the switch 166 provided in a ganged fashion with the door is connected to an energization power source, not shown. The switching transistor 165 is controlled responsive to the output Q of monostable multivibrator 167. The monstable multivibrator 167 may comprise a retriggerable monostable multivibrator adapted to be triggered responsive to the signal 132 obtained at the timing when the label adhering operation start switch i.e. the limit switch 59 is operated.

Figure 28:
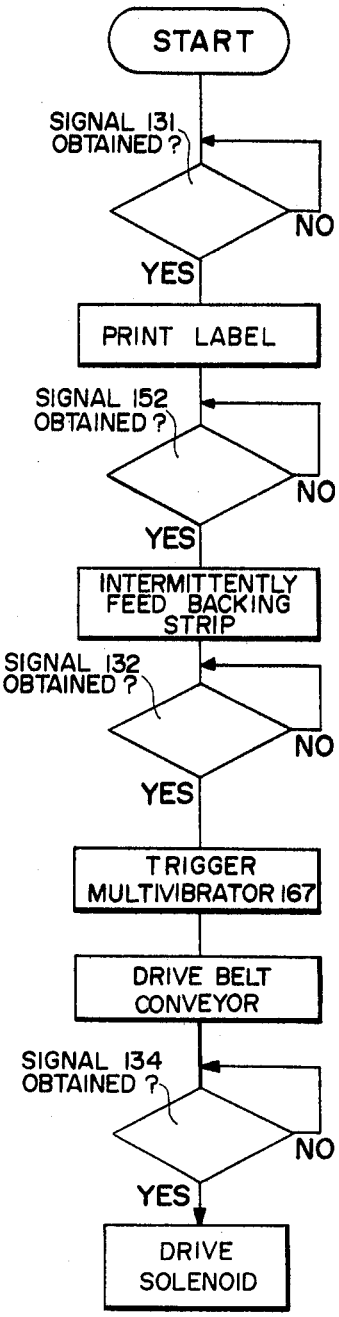
FIGS. 28 and 29 are flow diagrams associated with FIG. 27.
Figure 29:
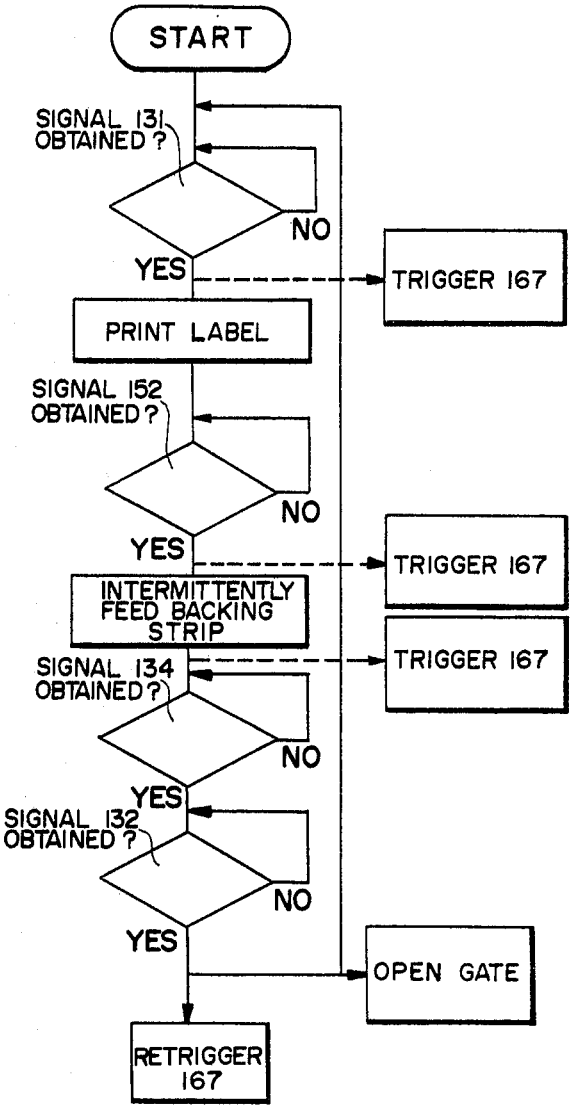

FIGS. 28 and 29 show a flow diagram of the operation from a stop state of the belt conveyor 42 until the start of the sticking operation and a flow diagram of the sticking operation during the operation of the belt conveyor 42, respectively. Now the operation of the FIG. 27 embodiment will be described with reference to FIGS. 28 and 29.

First referring to the FIG. 28 flow diagram, description will be made of a case where the belt conveyor 42 has been brought to a stop. If and when an article is placed on the weighing pan 3 of the weighing mechanism 121 at the time of stop of the belt conveyor 42, i.e. at the time of stop of the motor 49, whereupon the balance signal 131 is obtained from the weighing circuit 130, then the label is printed by means of the line printer 64 and the label as printed is transferred to the guide table or the printing table 71 by means of the intermittent feed device 70. Thereafter the article is removed from the weighing pan 3 of the weighing mechanism 121 and is placed on the prescribed label sticking position, whereupon the same is pressed on the reference surface 58 of the positioning device 56. Then the limit switch 59 detects the same to provide the high level signal 132. Accordingly, the monostable multivibrator 167 is triggered and the output Q becomes the high level. Accordingly, the switching transistor 165 is turned on and the two motors 16*a* and 49 are energized, thereby to start rotation. Accordingly, the fan, not shown, included in the fan box 16 starts rotating and at the same time the belt conveyor 42 is driven. When the belt conveyor 42 starts a transferring operation, the label as issued on the guide table 71 is sandwiched by the presser roller 53 and the large diameter roller 47, whereupon the label is transferred forward between the belt conveyor 42 and the guide plate 41, with the result that the label 7 is fed to the label retaining port 15. At that time the solenoids 24 are driven responsive to the passage detected signal 134 obtained from the light receiving part 79, thereby to perform the sticking operation, as described previously.

Whenever the above described monostable multivibrator 167 is triggered, the output Q thereof maintains the high level at least a predetermined time period, said approximately 5 to 10 seconds, whereby the motors 16*a* and 49 are energized. Accordingly, the sticking operation during the operation of the belt conveyor 42 is such that, as shown in FIG. 29, when the backing strip 8 is intermittently fed to issue a label to the guide table 71, the label as issued is fed immediately to the label retaining port 15 by means of the belt conveyor 42, whereupon the passage detected signal 134 is obtained from the light receiving part 79. Accordingly, the above described sticking operation is immediately effected by the limit switch 59.

In case where the limit switch 59 is not turned on within the above described output time period of the monostable multivibrator 167, the output of the monostable multivibrator is reversed thereafter so that the output Q thereof becomes the low level. Accordingly, the switching transistor 165 is turned off and both the fan motor 16*a* and the drive motor 49 for the belt conveyor are deenergized and are brought to a stop.

Meanwhile, if and when the above described maintenance door is opened during the operation of the above described motors 16*a* and 49, i.e. during the operation of the belt conveyor 42, the switch 166 provided in a ganged fashion therewith is turned off and the motors 16*a* and 49 are deenergized and are brought to a stop irrespective of whether the switching transistor 165 is turned on.

In case where it takes a little while before the travel speed of the belt conveyor 42 reaches a prescribed speed after the drive motor 49 is energized, there is a fear that a label 7 is not separated from the surface of the belt 48 of the belt conveyor 42. Accordingly, the above described embodiment was structured such that the monostable multivibrator 167 is triggered responsive to the signal 132; however, the above described problem can be obviated when the monostable multivibrator 167 is adapted to be retriggered responsive to the balance signal 131 from the weighing circuit 130, the print end signal 152 obtained from the line printer 64, as shown in FIG. 29, or at the timing of the intermittent feeding operation by the intermittent feed device 70.

As described in the foregoing, since according to the FIG. 27 embodiment, the drive motor 49 of the belt conveyor 42 is energized or deenergized responsive to the output of the monostable multivibrator 167, the transfer period of the belt conveyor 42 being driven in the high speed can be shortened without degrading an operating performance, and thus the life of the respective bearing portions of the belt conveyor 42, the drive motor 49 and the small diameter roller 44 and the support shaft 45 can be prolonged.

What is claimed is:

1. A label handling apparatus comprising label preparing means for preparing labels each being temporarily retained on a backing strip through an adhesive agent applied to one surface thereof and having desired data visibly borne on the other surface thereof by stripping said labels from said backing strip in preparation for sticking said stripped labels to objects, sticking means for sticking said prepared labels to objects, said sticking means comprising air current producing means for producing air currents to produce a positive pressure atmosphere and a negative pressure atmosphere, an atmosphere chamber adapted to selectively communicate with either said positive pressure atmosphere or said negative pressure atmosphere produced by said air current producing means, said atmosphere chamber formed with a portion communicating with the ambient air, said ambient air communicating portion being provided with a label retaining port for blowing off and projecting labels and for sucking and retaining labels, gate means for selecting said negative pressure atmosphere or said positive pressure atmosphere, said gate means comprising two gate members, said two gate members comprising opposed end edge portions, said gate members operable in a symmetrical manner so that opposed end edges are brought close to each other in a path closing state and so that said end edges are moved away from each other in a path opening state, gate means driving apparatus for driving and controlling said gate means whereby labels are blown off and projected or sucked and retained at the label retaining port depending upon the position of said gate members, transfer means for transferring said labels from said label preparing means to said sticking means, said transfer means including a moving portion which contacts only a portion of the surface of said label having said adhesive agent applied thereto so as to contact withdraw and transfer said label, and controlling means for controlling the relative timing between the label preparing operation in said label preparing means and the label sticking operation in said sticking means.

2. A label handling apparatus as set forth in claim 1, wherein said sticking means comprises a first air chamber, a second air chamber said air current producing means being a fan disposed in said first air chamber, said positive pressure atmosphere being produced on the blowing port side of said fan, said negative pressure atmosphere being produced on the suction port side of said fan, an air path for operatively connecting said blowing port of said fan to said second air chamber, a first communication aperture for establishing communication between said second air chamber and the ambient air, and a second communication aperture for establishing communication between said first and second air chambers, said label retaining port being formed in a wall surface of said second air chamber facing in the air blowing direction in said air path, said label retaining port serving to suck and retain along said wall surface a label fed by said transfer means, said gate means driving device being operable to move said gate means so as to bring said label retaining port into communication either with the suction port of said fan through said second communication aperture or with the blowing port of said fan.

3. A label handling apparatus as set forth in claim 2, which further includes stop means vertically formed on said wall surface of said second air chamber where said label retaining port exists, said stop means serving to stop the movement of a label which is transferred by said transfer device and which is about to be suckwise retained when the leading end edge of said label abuts against said stop means.

4. A label handling apparatus as set forth in claim 3, wherein the abutment surface of said stop against which said label abuts is formed with a plurality of ridges extending in the direction of flight of said label toward said object.

5. A label handling apparatus as set forth in claim 3, wherein the abutment surface of said stop means against which said label abuts is inclined to gradually open in the direction of flight of said lable toward said object.

6. A label handling apparatus as set forth in claim 2, wherein said first air chamber is also provided with a third communication aperture directly communicating with the ambient air, the size of said third communication aperture being so selected as to weaken the sucking force of said label retaining port by sharing in the amount of air being drawn from the suction port of said fan when said label retaining port is under the suction condition, and strengthen the blowing force of said label retaining port by supplementing the amount of air being drawn by said fan when said label retaining port is under the blowing condition.

7. A label handling apparatus as set forth in claim 2, wherein the gate means moved by said gate means driving device is adapted to rotate.

8. A label handling apparatus as set forth in claim 7, wherein said gate means comprises two gate members, said gate members being rotatably supported on a pair of support shafts extending parallel with each other, said second air chamber being divided into an upper chamber and a lower chamber when said two gate members are aligned with each other in a plane, said first communication aperture being provided in said upper chamber, said second communication aperture being provided in said lower chamber.

9. A label handling apparatus as set forth in claim 8, which further includes a flow regulating plate disposed in a plane containing the center line of said label retaining port and the center line of the blowing port of said fan.

10. A label handling apparatus as set forth in claim 8, wherein said two gate members are provided with turnbacks extending from the opposed ends thereof toward said label retaining port.

11. A label handling apparatus as set forth in claim 1, wherein said gate means driving device comprises an actuator coupled to said gate means for actuating the same.

12. A label handling apparatus as set forth in claim 10, wherein said actuator comprises a plunger coupled to said gate means, and a solenoid provided associated with said plunger.

13. A label handling apparatus as set forth in claim 1, wherein said transfer means includes a moving portion which contacts only a portion of the surface of said label having said adhesive agent applied thereto so as to contact withdraw said label from the label preparing means, and conveying means for receiving said withdrawn label for conveying said label to the applying means, said conveying means not being in direct contact with the adhesive label surface during contact withdrawal of said label from the label preparing means thereby reducing resistance and wear at said conveying means during transfer of labels from said label preparing means to the label applying means.

14. A label handling apparatus as set forth in claim 13, wherein the initial end of said label retaining port and the terminal end of the moving portion for label transfer of said transfer device partly overlap each other.

15. A label handling apparatus as set forth in claim 14, wherein the end edge of the opening constituting said label retaining port corresponding to the initial end of said label retaining port is notched, the notch overlapping the terminal end of the moving portion for label transfer.

16. A label handling apparatus as set forth in claim 1, wherein the moving portion for label transfer includes the peripheral surface of a rotating roller.

17. A label handling apparatus as set forth in claim 16, which further includes a pressure member opposed to the peripheral surface of said roller to urge said label toward the peripheral surface of said roller.

18. A label handling apparatus as set forth in claim 17, wherein said label pressing member is a second rotatable roller disposed axially parallel with said first roller and contacting the peripheral surface of said first roller.

19. A label handling apparatus as set forth in claim 17, wherein said label pressing member is a plate spring resiliently abutting against the peripheral surface of said roller.

20. A label handling apparatus as set forth in claim 17, wherein the peripheral surface of said roller is formed with at least one annular groove extending circumferentially thereof, said label pressing member being inserted in said annular groove in such a manner as not to contact the wall surface defining said annular groove.

21. A label handling apparatus as set forth in claim 20, wherein said label pressing member is a plate spring.

22. A label handling apparatus as set forth in claim 20, wherein said label pressing member is an annular projection circumferentially formed on the peripheral surface of a second rotatable roller disposed axially parallel with said first roller.

23. A label handling apparatus as set forth in claim 1, wherein the moving portion for label transfer includes a flexible, entrained, intervening link entrained around and extending between a pair of axially parallel rollers.

24. A label handling apparatus as set forth in claim 23, wherein said flexible, entrained, intervening link has at least its outer surface made of silicone rubber.

25. A label handling apparatus as set forth in claim 1, wherein said transfer means is normally rendered in an operating state.

26. A label handling apparatus as set forth in claim 1, which further comprises retriggerable timing means for defining an operating time period of said transfer means, means for triggering said retriggerable timing means, and driving means responsive to the output of said retriggerable timing means for driving said transfer means.

27. A label handling apparatus as set forth in claim 26, which further comprises means for commanding initiation of a sticking operation of said sticking means, and wherein said triggering means is adapted to be responsive to the command of said means for commanding initiation of the sticking operation to trigger said retriggerable timing means.

28. A label handling apparatus as set forth in claim 27, wherein said means for commanding initiation of the sticking operation comprises a switch.

29. A label handling apparatus as set forth in claim 28, wherein said switch is disposed such that the same is enabled when said object is brought to a prescribed position of said sticking means.

30. A label handling apparatus as set forth in claim 26, wherein said labeling preparing means comprises means for printing labels, and said triggering means is adapted to be responsive to termination of the printing operation by said label printing means to trigger said retriggerable timing means.

31. A label handling apparatus as set forth in claim 26, which further comprises weighing means having a weighing mechanism for measuring the weight of said object, and wherein said triggering means is adapted to be responsive to a balanced state of said weighing mechanism to trigger said retriggerable timing means.

32. A label handling apparatus as set forth in claim 1, wherein said label preparing means comprises means for printing desired information on said other surface of said labels.

33. A label handling apparatus as set forth in claim 32, which further comprises weighing means having a weighing mechanism for measuring the weight of said object, and wherein said desired information being printed by said label printing means comprises information associated with the weight of said object.

34. A label handling apparatus as set forth in claim 33, wherein said controlling means is responsive to a predetermined signal obtained from said weighing means for enabling said printing means.

35. A label handling apparatus as set forth in claim 34, wherein said predetermined signal obtained from said weighing means comprises a balance signal indicating that said weighing mechanism has reached a stable state.

36. A label handling apparatus as set forth in claim 34, wherein said controlling means comprises mode selecting means for selecting an automatic operation mode or a manual operation with respect to the printing operation by said printing means, and which further comprises means responsive to selection of said automatic operation mode by said mode selecting means for enabling said predetermined signal and responsive to selection of said manual operation mode by said mode selecting means for disabling said predetermined signal.

37. A label handling apparatus as set forth in claim 1, wherein said controlling means comprises first label detecting means for detecting the label as prepared having being transferred to said label sticking means by said transfer means, and means responsive to the detected output from said transfer detecting means and the signal associated with the sticking operation by said sticking means for providing a prepare command to said label preparing means.

38. A label handling apparatus as set forth in claim 37, wherein said controlling means comprises means for commanding initiation of the sticking operation by said label sticking means, and said associated signal comprises a commanding signal from said commanding means.

39. A label handling apparatus as set forth in claim 38, which further comprises label preparation commanding means, and wherein said controlling means is responsive to the output of said label preparation commanding means for forcing said label preparing means in a preparing state irrespective of said commanding signal and said transfer detected output.

40. A label handling apparatus as set forth in claim 37, wherein said controlling means comprises means for determining propriety of preparation of the following label, and means for disabling preparation of the following label when the preparation is determined as improper by said determining means.

41. A label handling apparatus as set forth in claim 40, wherein said disabling means is structured to disable said preparation command.

42. A label handling apparatus as set forth in claim 1, wherein said controlling means comprises first label detecting means for detecting said label as prepared having been transferred to said label sticking means by said transfer means, means for commanding initiation of the sticking operation by said first label sticking means, and means for enabling said label sticking means when the detected output is obtained from said label detecting means and the command is obtained from said operation initiation commanding means.

43. A label handling apparatus as set forth in claim 42, wherein said sticking operation initiation commanding means comprises a switch.

44. A label handling apparatus as set forth in claim 43, wherein said switch is disposed such that the same is enabled when said object is brought in a predetermined position of said sticking means.

45. A label handling apparatus as set forth in claim 44, wherein said switch comprises a limit switch adapted to be operable in direct or indirect abutment on said object.

46. A label handling apparatus as set forth in claim 42, wherein said first label detecting means is disposed such that the same detects said label as prepared on the transfer path of said transfer means.

47. A label handling apparatus as set forth in claim 46, wherein said first label detecting means comprises a light emitting device for emitting light to said transfer path, and a light receiving device provided associated with said light emitting device and the absence or presence of said label responsive to said emitted light.

48. A label handling apparatus as set forth in claim 31, wherein said label preparing means comprises intermittent feed means responsive to completion of a printing operation of said printing means for feeding in an intermittent manner said label to a print position by said printing means with said labels temporarily retained on a backing strip, and second label detecting means responsive to said labels being positioned at said printing means for providing a feed stop signal to said intermittent feed means.

49. A label handling apparatus as set forth in claim 1, wherein said object comprises a commodity.

50. A label handling apparatus as set forth in claim 11, wherein said actuator comprises a drive motor.

51. A label handling apparatus comprising label preparing means for preparing labels each being temporarily retained on a backing strip through an adhesive agent applied to one surface thereof and having desired data visibly borne on the other surface thereof and for stripping said labels from said backing strip in preparation for applying and sticking said stripped labels to objects, label applying means for applying and sticking said prepared labels to objects, said label applying means comprising air current producing means for producing air currents to establish positive pressure air and negative pressure air, an air chamber adapted to selectively communicate with either the positive pressure air or said negative pressure air established by said air current producing means, said air chamber comprising a portion communicating with the ambient air, said ambient air communicating portion being provided with a label retaining port for sucking retaining labels or for blowing off and projecting labels, gate means for selecting said negative pressure air or said positive pressure air, said gate means comprising two gate members, said two gate members comprising operatively opposed end edge portions, said gate members moveably mounted in a symmetrical manner so that the opposed end edge portions may be brought close to each other centrally over the label retaining port in a path closing state for blocking positive pressure air at the label retaining port while communicating negative pressure, and so that said end edges may be moved away from each other in a path opening state for centrally blowing off and ejecting a label retained at the label retaining port, gate means driving apparatus for driving and controlling said gate means whereby labels are blown off and projected or sucked and retained at the label retaining port according to the position of said gate members, transfer means for transferring said labels from said label preparing means to said label applying means, said transfer means including roller means which contact only a portion of the surface of said label having said adhesive agent applied thereto so as to contact withdraw said label from said label preparing means, and conveying means for receiving said withdrawn label and conveying said label to the label applying means, said conveying means not being in direct contact with the adhesive surface of said label during contact withdrawal of the label from the label preparing means, thereby reducing resistance and wear at the conveying means during transfer of said labels from the label preparing means, and controlling means for controlling the relative timing between the label preparing operation in said label preparing means and the label applying and sticking operation in said label applying means.

* * * * *

UNITED STATES PATENT OFFICE

CERTIFICATE OF CORRECTION

Patent No. 4,295,915 Dated October 20, 1981

Inventor(s) Tadahiro Sakaguchi et al

It is certified that error appears in the above-identified patent and that said Letters Patent are hereby corrected as shown below:

In claim 5, line 5, "lable" should read --label--.

In claim 36, line 5, " a manual operation with" should read -- a manual operation mode with-- .

Signed and Sealed this

Sixteenth Day of February 1982

[SEAL]

Attest:

GERALD J. MOSSINGHOFF

Attesting Officer

Commissioner of Patents and Trademarks